US011411298B2

(12) United States Patent
White et al.

(10) Patent No.: US 11,411,298 B2
(45) Date of Patent: Aug. 9, 2022

(54) LOWER ELECTRODE EXTENSION FOR SUB-SURFACE ELECTROMAGNETIC TELEMETRY SYSTEM

(71) Applicant: Scientific Drilling International, Inc., Houston, TX (US)

(72) Inventors: Matthew A. White, Templeton, CA (US); Brett Van Steenwyk, Paso Robles, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 17/472,612

(22) Filed: Sep. 11, 2021

(65) Prior Publication Data

US 2022/0085482 A1 Mar. 17, 2022

Related U.S. Application Data

(60) Provisional application No. 63/077,403, filed on Sep. 11, 2020.

(51) Int. Cl.
*H01Q 1/22* (2006.01)
*E21B 47/13* (2012.01)
(Continued)

(52) U.S. Cl.
CPC ..... *H01Q 1/22* (2013.01); *E21B 47/13* (2020.05); *H01Q 1/10* (2013.01); *H01Q 3/34* (2013.01)

(58) Field of Classification Search
CPC ... H01Q 1/22; H01Q 1/10; H01Q 3/34; E21B 47/13
See application file for complete search history.

(56) References Cited

U.S. PATENT DOCUMENTS 4,057,781 A * 11/1977 Scherbatskoy ..... E21B 47/13 340/854.6
4,126,848 A * 11/1978 Denison ..... E21B 23/14 340/854.6

(Continued)

OTHER PUBLICATIONS

International Search Report and Written Opinion issued in application No. PCT/US21/49977, dated Dec. 8, 2021, 10 pages.

(Continued)

*Primary Examiner* — Ryan W Sherwin
(74) *Attorney, Agent, or Firm* — Ewing & Jones, PLLC

(57) ABSTRACT

An extended dipole antenna for an uplink transmitter positioned in a wellbore includes an electromagnetic telemetry system interface sub, wired or lined drill pipe segment, and upper dipole terminating sub. The electromagnetic telemetry interface sub includes an outer tubular in electrical contact with a negative output of the uplink transmitter and an inner conductor in electric contact with a positive output of the uplink transmitter. The wired or lined drill pipe segment includes an outer tubular in electrical contact with the outer tubular of the electromagnetic telemetry interface sub and an inner conductor in electric contact with the inner conductor of the electromagnetic telemetry system interface sub. The upper dipole terminating sub including an outer tubular at least partially in electric contact with the outer tubular of the wired or lined drill pipe segment and an inner conductor in electric contact with the inner conductor of the wired or lined drill pipe segment. The upper dipole terminating sub includes an electrical connection between the inner conductor of the upper dipole terminating sub and the inner conductor of the upper dipole terminating sub.

6 Claims, 18 Drawing Sheets

(51) Int. Cl.
*H01Q 1/10* (2006.01)
*H01Q 3/34* (2006.01)

(56) References Cited

U.S. PATENT DOCUMENTS

| | | | | |
|---|---|---|---|---|
| 5,883,516 | A * | 3/1999 | Van Steenwyk | G01V 3/20 324/369 |
| 2004/0119607 | A1* | 6/2004 | Davies | E21B 17/028 340/854.4 |
| 2006/0202852 | A1 | 9/2006 | Peter et al. | |
| 2015/0211307 | A1* | 7/2015 | Minosyan | E21B 17/003 166/66 |
| 2016/0053610 | A1 | 2/2016 | Switzer et al. | |
| 2016/0146000 | A1 | 5/2016 | Logan et al. | |
| 2017/0227667 | A1* | 8/2017 | DePavia | G01V 3/083 |
| 2017/0362931 | A1* | 12/2017 | Homan | E21B 17/023 |
| 2019/0003302 | A1 | 1/2019 | Logan et al. | |
| 2020/0088026 | A1 | 3/2020 | Buternowsky et al. | |
| 2021/0404326 | A1* | 12/2021 | Wilson | E21B 47/13 |

OTHER PUBLICATIONS

Chhikara, et al., "Noise cancellation using adaptive algorithms", International Journal of Modern Engineering Research (IJMER), vol. 2, Issue 3, May-Jun. 2012, pp. 792-795.

Sachdeva, et al., "Performance Analysis of Conventional Diversity Combining Schemes in Rayleigh Fading Channel", International Journal of Advanced Research in Computer Science and Software Engineering, vol. 2, Issue 6, Jun. 2012, pp. 197-201.

K. M. Cheung, "Eigen Theory for Optimal Signal Combining: A Unified Approach", TDA Progress Report 42-126, Aug. 15, 1996, pp. 1-9.

Jack H. Winters, "Optimum Combining in Digital Mobile Radio with Cochannel Interference", IEEE Transaction on Vehicular Technology, vol. VT-33, No. 3, Aug. 1984, pp. 144-155.

Holter, et al., "The Optimal Weights of a Maximum Ratio Combiner Using an Eigenfilter Approach", Norwegian University of Science and Technology Department of Telecommunications, Jan. 2002, pp. 1-4.

* cited by examiner

LOWER ELECTRODE EXTENSION FOR SUB-SURFACE ELECTROMAGNETIC TELEMETRY SYSTEM

CROSS-REFERENCE TO RELATED APPLICATIONS

This application is a nonprovisional application which claims priority from U.S. provisional application No. 63/077,403, filed Sep. 11, 2020, the entirety of which is hereby incorporated by reference.

TECHNICAL FIELD

Field of the Disclosure

The present disclosure relates generally to wellbore communications and more specifically to transmitting data between a downhole location and the surface or between a downhole location and a second downhole location

Background of the Disclosure

During a drilling operation, data may be transmitted from a downhole transmitter located on a downhole tool included as part of the bottom hole assembly (BHA) of a drill string positioned in a wellbore. The data transmitted from the downhole transmitter may be received by a surface receiver, or by a downhole receiver located elsewhere in the BHA, drillstring, or in an adjacent wellbore. Data transmitted from the downhole transmitter may include, for instance, properties of the surrounding formation, downhole conditions, status of downhole equipment, and the properties of downhole fluids. Electronics present in the BHA may be used for telemetry of data to the surface, collecting data using sensors such as vibration sensors, magnetometers, inclinometers, accelerometers, nuclear particle detectors, electromagnetic detectors, acoustic detectors, acquiring images, measuring fluid flow, determining direction, emitting signals, particles or fields for detection by other devices, interfacing to other downhole equipment, and sampling downhole fluids. The BHA may also include mud motors and steerable drilling systems, such as a rotary steerable system (RSS), which may be used to steer the wellbore as it is drilled. By receiving data from the BHA, an operator may have access to the data collected by the sensors.

The drill string can extend thousands of feet below the surface. Typically, the bottom end of the drill string includes a drill bit for drilling the wellbore. Drilling fluid, such as drilling "mud", may be pumped through the drill string. The drilling fluid typically cools and lubricates the drill bit and may carry cuttings back to the surface. Drilling fluid may also be used for control of bottom hole pressure. In situations where the formation may be damaged by the pressure generated by the column of drilling fluid, mist or foam may be used to reduce the pressure on the formation due to the fluid column.

Examples of telemetry systems for transmitting data to the surface include mud pulse (MP), electromagnetic (EM), wired drill pipe, fiber optic cable, and drill collar acoustic. Traditionally, MP and EM telemetry may be less expensive to deploy than hardwired drill pipe, fiber optic cable and drill collar acoustic systems. An EM system may operate when pumps are not operating to circulate fluid through the drill string, which in certain operations may be necessary for use of MP systems. In certain traditional uses, an EM telemetry system may transmit data at a higher data rate compared to an MP system. EM systems may also operate when foam or mist are used as a drilling fluid which may hinder the generation or reception of mud pulses of sufficient amplitude for reliable MP telemetry. EM systems may be limited in depth of reliable operation due to attenuation of the signal received at surface, i.e., EM signals may be reduced to an amplitude that is below the surface receiver noise level due to noise generated by various pieces of drilling equipment used to drill the well.

SUMMARY

The present disclosure provides for an extended dipole antenna for an EM telemetry uplink transmitter positioned in a wellbore. The extended dipole antenna may include an electromagnetic telemetry system interface sub. The electromagnetic telemetry interface sub may include an outer tubular and an inner conductor. At least a portion of the outer tubular of the electromagnetic telemetry interface sub may be in electrical contact with a negative output of the uplink transmitter. The inner conductor of the electromagnetic telemetry system interface sub may be in electric contact with a positive output of the uplink transmitter. The extended dipole antenna may include a wired or lined drill pipe segment. The wired or lined drill pipe segment may include an outer tubular and an inner conductor. The outer tubular may be in electrical contact with the outer tubular of the electromagnetic telemetry interface sub. The inner conductor may be in electrical contact with the inner conductor of the electromagnetic telemetry system interface sub. The extended dipole antenna may include an upper dipole terminating sub. The upper dipole terminating sub may include an outer tubular and an inner conductor. The outer tubular may be at least partially in electrical contact with the outer tubular of the wired or lined drill pipe segment. The inner conductor of the upper dipole terminating sub may be in electrical contact with the inner conductor of the wired or lined drill pipe segment. The upper dipole terminating sub may include an electrical connection between the inner conductor of the upper dipole terminating sub and the inner conductor of the upper dipole terminating sub.

The present disclosure also provides for a system. The system may include a drill string. The drill string may include an EM telemetry uplink transmitter, the uplink transmitter having a positive output and a negative output. The drill string may include an extended dipole antenna. The extended dipole antenna may include an electromagnetic telemetry system interface sub. The electromagnetic telemetry interface sub may include an outer tubular and an inner conductor. At least a portion of the outer tubular of the electromagnetic telemetry interface sub may be in electrical contact with the negative output of the uplink transmitter. The inner conductor of the electromagnetic telemetry system interface sub may be in electric contact with the positive output of the uplink transmitter. The extended dipole antenna may include a wired or lined drill pipe segment. The wired or lined drill pipe segment may include an outer tubular and an inner conductor. The outer tubular may be in electrical contact with the outer tubular of the electromagnetic telemetry interface sub. The inner conductor may be in electrical contact with the inner conductor of the electromagnetic telemetry system interface sub. The extended dipole antenna may include an upper dipole terminating sub. The upper dipole terminating sub may include an outer tubular and an inner conductor. The outer tubular may be at least partially in electrical contact with the outer tubular of the wired or lined drill pipe segment. The inner conductor of the upper dipole terminating sub may be in electrical contact with the inner conductor of the wired or lined drill pipe segment. The upper dipole terminating sub may include an electrical connection between the inner conductor of the upper dipole terminating sub and the inner conductor of the upper dipole terminating sub

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
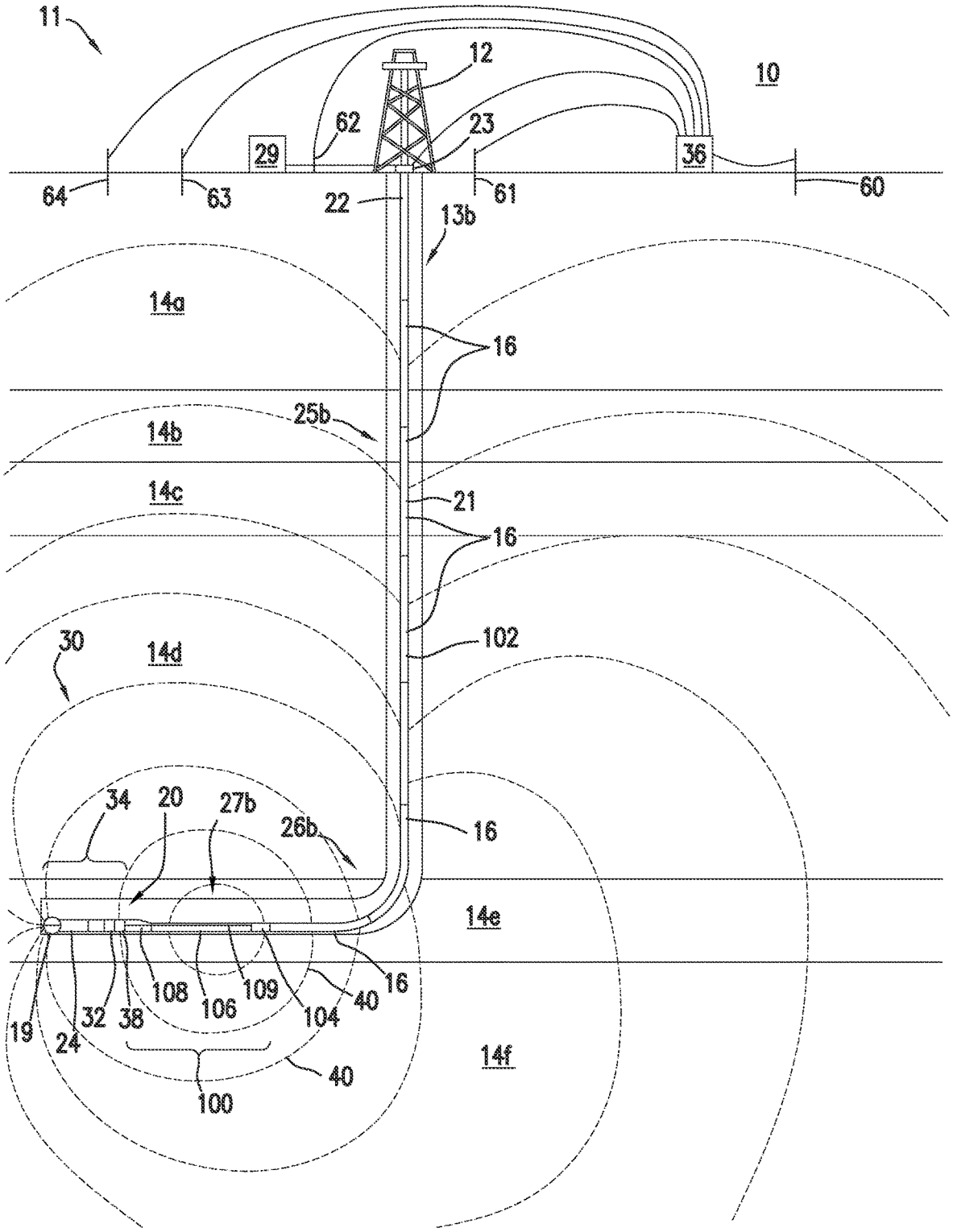
FIG. 1 is a schematic view of a drilling system consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling site 10, where drilling system 11 may be used to drill one or more wellbores. One or more drilling rigs 12 may drill wellbores 13*b* through, for instance, formations 14*a*, 14*b*, 14*c*, 14*d* and into target formation 14*e* located above formation 14*f*. FIG. 1 depicts wellbore 13*b* being drilled with drill bit 19 positioned at bottom end 20 of drill string 21. Drill string 21 may be made up of a plurality of tubular members including, for example and without limitation, drill pipe, collars, downhole tools, or other tubular members, which may be threadedly coupled end-to-end to extend into wellbore 13*b* as wellbore 13*b* is formed. Drill string 21 is supported at upper section 22 by rig equipment 23. Drill bit 19 may be rotated by a fluid motor, such as mud motor 24. Rig equipment 23 may pump fluid, such as drilling mud, foam, or mist through drill string 21 to drill bit 19, rotate drill string 21, raise and lower drill string 21 within wellbore 13*b*, provide emergency pressure isolation in the event of a high pressure kick encountered during drilling such as performed by a blow out preventer (BOP), in addition to other functions related to drilling of wellbore 13*b*. Portions of rig equipment 23 may be powered by generator 29. Wellbore 13*b* is shown as a horizontal wellbore consisting of vertical section 25*b*, curve section 26*b*, and horizontal section 27*b*. Wellbore 13*b* is exemplary and one of ordinary skill in the art with the benefit of this disclosure will recognize that other configurations are contemplated by this disclosure. For example and without limitation, wellbore 13*b* may be a vertical well, slant well, S shaped well, or any other well shape known within the art.

Drilling system 11 may include an EM telemetry system 30. EM telemetry system 30 may include one or more uplink transmitters 32 located on BHA 34 for transmitting an EM signal to uplink receiver 36 located at the surface. Uplink transmitter 32 may include electronics that enable it to drive modulated voltage and current waveforms across its two output electrical connections, herein referred to as positive and negative outputs. These positive and negative output designations are merely descriptive titles and are not intended to limit the possible signal polarities that the electronics drive onto those outputs. In some embodiments uplink transmitter 32 may also include a downlink receiver to receive EM signals from the surface. Those skilled in the art will recognize that an extended dipole antenna as described in this patent application may also be used to improve downlink receiver performance. In some embodiments, BHA 34 includes an electrically insulating gap 38 across which a voltage is impressed, causing current to flow within BHA 34 and drill string 21 and into the surrounding formations as depicted diagrammatically by lines of current 40. In other embodiments (not shown), BHA 34 may include a toroid for inducing currents within BHA 34 and drill string 21, which will flow through the surrounding formations as diagrammatically depicted by lines of current 40.

In some embodiments, uplink receiver 36 may be positioned at the surface to receive signals transmitted by uplink transmitters 32. In some embodiments, uplink receiver 36 may measure the signal based on one or more surface electrodes. In some embodiments, ground electrodes 60, 61 operate as surface electrodes. Ground electrodes 60, 61 may be connected to uplink receiver 36 by an insulated wire which may, in some embodiments, be shielded. In a non-limiting embodiment, one or more of ground electrodes 60, 61 may be rods of conductive material such as, for example, copper or iron. In some embodiments, ground electrodes 60, 61 may be driven into surface formation 14*a* by mechanical means, thereby making electrical contact with formation 14*a*. In some embodiments, ground electrodes 60, 61 are positioned at a distance from rig equipment 23, generator 29 and power cables connecting generator 29 to rig equipment 23 which may reduce received noise. The distance between ground electrodes 60, 61 and rig equipment 23, generator 29 and the connecting power cables may be between approximately 50 ft and 5000 ft or between approximately 200 ft and 1000 ft.

In some embodiments, uplink receiver 36 may include a noise cancellation system for cancelling noise obtained from one or more noise sensors employed to sense noise generated by, for example, motors used to raise or lower BHA 34 within wellbore 13*b*, operate drilling fluid pumps, rotate drill string 21, or other operations requiring electrical power to drill wellbore 13*b*. One non-limiting example of a noise sensor is current sense coil 62. Current sense coil 62 may consist of a coil wound around a rod-shaped core of magnetic material such as, for example iron or permendur. Current sense coil 62 may be placed adjacent and substantially perpendicular to one or more power cables supplying power from generator 29 to one or more pieces of rig equipment 23. When current passes through power cables, a magnetic field may surround the cables. A portion of the magnetic field may pass through the magnetic core of current sense coil 62, which may induce a current in the coil of current sense coil 62. Current sense coil 62 may further include one or more resistors connected in series with the coil of current sense coil 62 which may operate to limit the induced voltage. Each end of the series arrangement of coil and one or more resistors of current sense coil 62 may be connected to two insulated wires, preferably in twisted pair arrangement, the ends of which may be connected to uplink receiver 36.

In another embodiment, a magnetometer (not shown) with sensitive axis aligned substantially perpendicular to one or more power cables supplying power from generator 29 to one or more pieces or rig equipment 23 may be used as a noise sensor. Another non-limiting example of a noise sensor is a pair of electrodes such as, for example, ground electrodes 63 and 64, which may be of similar construction to ground electrodes 60 and 61, and may be positioned near generator 29, near the power cables connecting generator 29 to portions of rig equipment 23 or near rig equipment 23. In certain embodiments, the measured noise signal from ground electrodes 63 and 64 may also include a portion of the telemetry signal from EM telemetry system 30. In such embodiments, the process of cancelling noise from the received telemetry signal using the measured noise signal from ground electrodes 63 and 64 may result in a reduction in amplitude of the resultant noise cancelled telemetry signal, which may be undesirable due to a resultant decrease in signal to noise ratio. In some embodiments, ground electrodes 63 and 64 may be moved in relation to one another, the upper section 22 of drill-string 21, and generator 29 so as to reduce the amplitude of the telemetry signal of EM telemetry system 30 present in the measured noise signal from ground electrodes 63 and 64 and maximize the amplitude of the measured noise. Without being bound by theory, the amplitude of the telemetry signal present in the measured noise signal may be reduced by positioning ground electrodes 63 and 64 approximately equidistant radially from upper section 22 of drill-string 21 due to the tendency for the current of the telemetry signal of EM telemetry system 30 to return to drill-string 21 in a substantially radial direction. In some embodiments, then, the movement of ground electrodes 63 and 64 in relation to one another, the upper section of 22 of drill-string 21 and generator 29 may be guided by positioning ground electrodes 63 and 64 first approximately equidistant radially from upper section 22 of drill-string 21 and then adjusting the placement of or moving ground electrodes 63, 64 from the initial locations so as to maximize the amplitude of the measured noise and minimize the amplitude of the telemetry signal of EM telemetry system 30 present in the measured noise signal.

Figure 4:
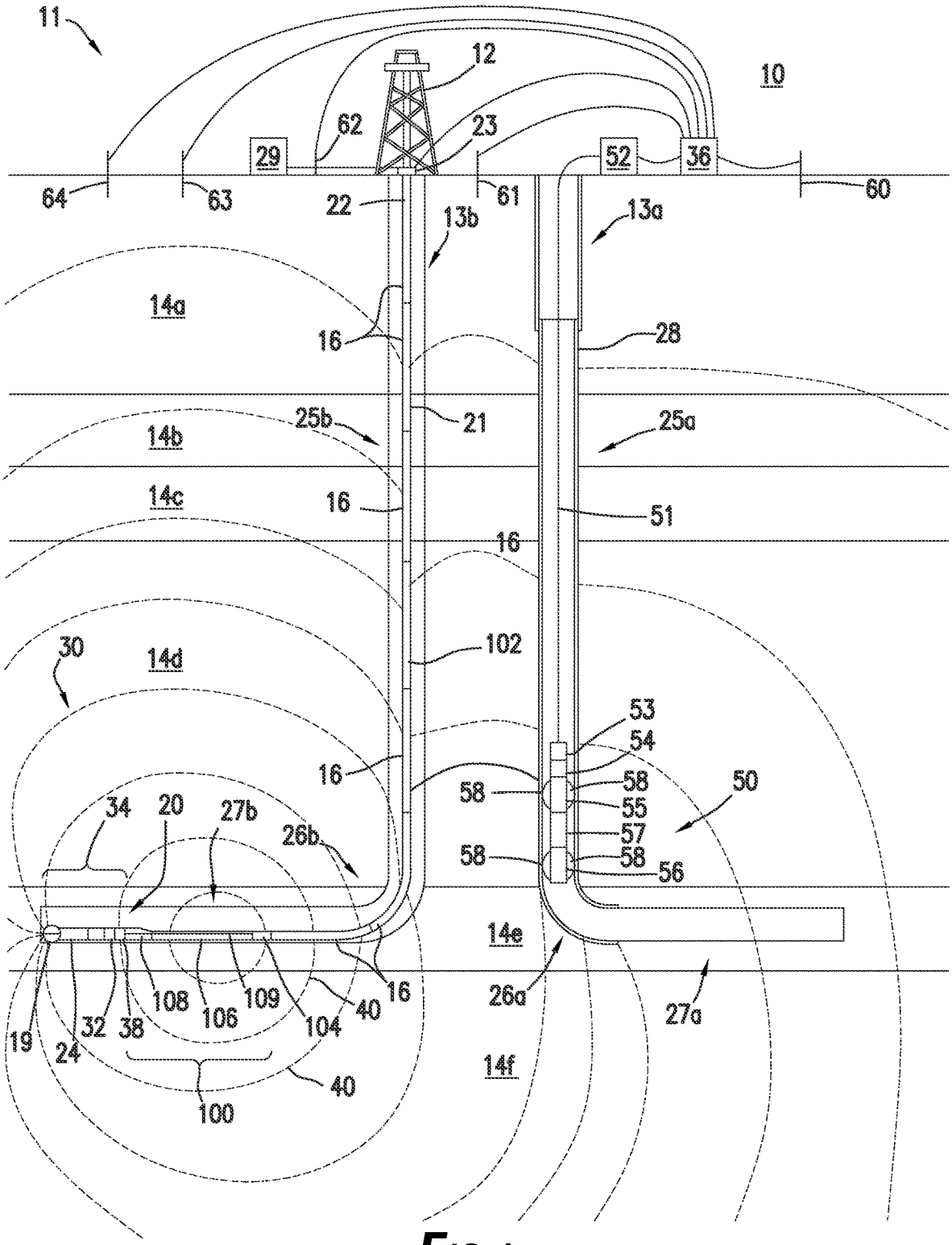
FIG. 4 is a schematic view of a drilling system consistent with at least one embodiment of the present disclosure.
Figure 5:
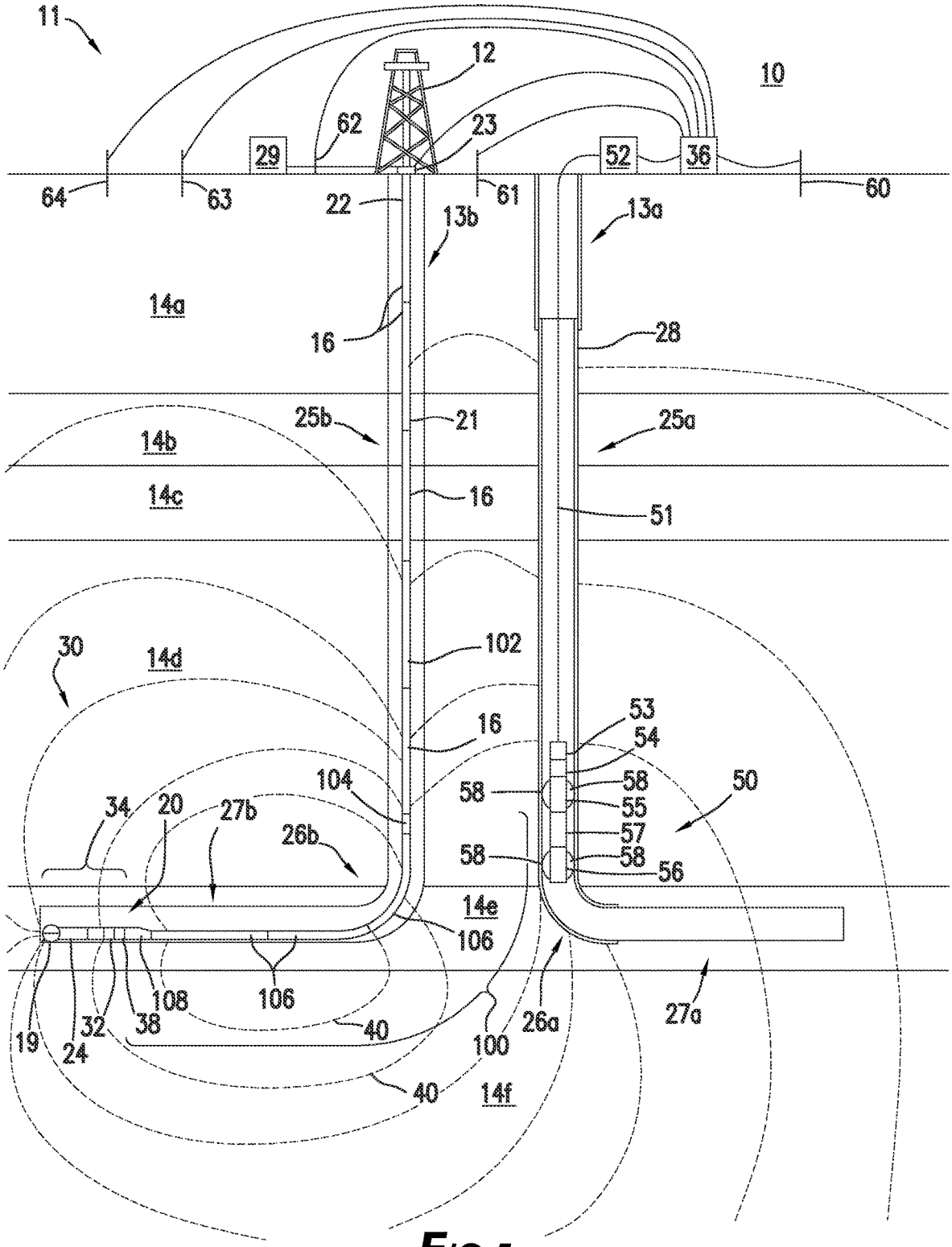
FIG. 5 is a schematic view of a drilling system consistent with at least one embodiment of the present disclosure.

In some embodiments, as depicted in FIGS. 4, 5, drilling system 11 may drill multiple wellbores. In certain embodiments, the wellbores may be drilled in succession, that is, a first wellbore may be drilled, followed later in time by a second wellbore and, in some embodiments, by subsequent wellbores. Drilling system 11 may include one or more drilling rigs 12 used to drill, in succession, a first wellbore 13*a*, a second wellbore 13*b* and, in certain embodiments, additional wellbores (such as, but not limited to, a third wellbore, fourth wellbore, etc., not shown) at drilling site 10. One or more drilling rigs 12 may drill wellbores 13*a* and 13*b* through, for instance, formations 14*a*, 14*b*, 14*c*, 14*d* and into target formation 14*e* located above formation 14*f*.

Wellbore 13*a* and 13*b* are shown as horizontal wellbores consisting of vertical sections 25*a* and 25*b*, respectively, curve sections 26*a* and 26*b*, respectively and horizontal sections 27*a* and 27*b* respectively. Wellbores 13*a* and 13*b* are exemplary and one of ordinary skill in the art with the benefit of this disclosure will recognize that other configurations are contemplated by this disclosure. Wellbores 13*a* and 13*b* may be vertical wells, slant wells, S shaped wells or any other well shape known within the art. Wellbore 13*a* may be configured differently than wellbore 13*b*. FIGS. 4, 5 also depict wellbores 13*a* and 13*b* as landing horizontal sections, 27*a* and 27*b* respectively, into the same target formation 14*e* though in some situations the target formations for wellbores 13*a* and 13*b* may differ.

FIGS. 4, 5 depict wellbore 13*a* as having been drilled in its entirety, extending through the full range of horizontal section 27*a*. In some embodiments, wellbore 13*a* may be only partially drilled when drilling of wellbore 13*b* commences. For example, drilling rig 12 may successively drill vertical section 25*a* and curve section 26*a* of wellbore 13*a* followed by vertical section 25*b* and curve section 26*b* of wellbore 13*b* followed by the vertical sections and curve sections of any additional wellbores drilled at drill site 10. After drilling all vertical sections and curve sections for all of the wellbores drilled at drill site 10, drilling rig 12 may successively drill horizontal section 27*a* of wellbore 13*a* followed by horizontal section 27*b* of wellbore 13*b* followed by the horizontal section of any other wellbores drilled at drill site 10.

In the embodiment shown in FIGS. 4, 5, casing string 28 is installed in wellbore 13*a* (referred to herein as "casing" a wellbore). In certain embodiments, a section of wellbore 13*a* may be cased. Casing string 28 may consist of multiple segments of conductive tubular pipe of the same or varied diameter which may be cemented into wellbore 13*a*. Without being bound by theory, the lower resistance of casing string 28 as compared to the surrounding formations may concentrate the currents of EM telemetry system 30 due to the tendency for electrical currents to take the path of least resistance. Downhole receiving system 50 may be located within wellbore 13*a*, suspended on wireline 51 by wireline unit 52 located at the surface, for instance, to locate downhole receiving system 50 in proximity to EM telemetry system 30. The proximity of downhole receiving system 50 to the source of the EM telemetry signal of EM telemetry system 30 and the current concentrating effect of casing string 28 may operate to increase the signal strength received by downhole receiving system 50 as compared to the signal at surface. Such positioning of downhole receiving system 50 to the source of EM telemetry system 30 may allow the receiving system to operate reliably at greater depths than if the receiving system were located at the surface.

In some embodiments, casing string 28 may include one or more sections of non-conductive tubular pipe. A non-conductive section of casing string 28 may increase the resistance across which an EM telemetry signal of EM telemetry system 30 may be received. The non-conductive section of casing string 28 may be made of, for example, carbon fiber, or any other substantially non-conductive material with suitable yield and tensile strength.

In some embodiments, wireline unit 52 may lower downhole receiving system 50 to a depth proximate uplink transmitter 32 of EM telemetry system 30 or extended dipole antenna 100 as drilling system 11 drills wellbore 13*b*. In such embodiments, the signal strength received at uplink receiver 36 may be increased by following the progression of BHA 34 with downhole receiving system 50 as BHA 34 descends into wellbore 13*b*. Operation of motors in wireline unit 52 to lower downhole receiving system 50 into wellbore 13*a* may produce noise, which may corrupt a received signal, i.e., the EM telemetry signal received by downhole receiving system 50. In certain embodiments, to reduce the corruption of the received signal, the operation of lowering downhole receiving system 50 within wellbore 13*a* may be performed at discrete depth intervals rather than continuously. Repositioning of downhole receiving system 50 may occur at intervals of approximately 2000 ft or at intervals of approximately 1000 ft or as little as approximately 200 ft. Once wireline unit 52 has lowered downhole receiving system 50 to a depth at which the received signal strength is observed to be near its maximum, motors and generators of wireline unit 52 may be turned off and a brake engaged to avoid inducing noise from the motors and generators into the received signal.

In some embodiments, wireline unit 52 lowers downhole receiving system 50 into wellbore 13*a* to a predetermined depth after which any additional length of wireline 51 may be cut off and the portion left in wellbore 13*a* tied off at surface to suspend wireline 51 and downhole receiving system 50 in wellbore 13*a*. In embodiments where downhole receiving system 50 is lowered to a predetermined depth, the received telemetry signal may be of lower amplitude than embodiments where wireline unit 52 lowers downhole receiving system 50 into wellbore 13*a* so as to follow uplink transmitter 32 as it descends wellbore 13*b*. However, cutting off the excess length of wireline 51 allows wireline unit 52 to be moved from drilling site 10 and used in a different location during drilling of wellbore 13*b* or any additional wellbores drilled at drilling site 10. In some embodiments, the predetermined depth selected for positioning of downhole receiving system 50 may be based on the expected depth at which the signal received at uplink receiver 36 drops into the noise level making telemetry unreliable. This determination may be made, for instance during drilling of wellbore 13*a* or drilling of other wellbores at other drilling sites in the general geographical location. The predetermined depth at which downhole receiving system 50 is positioned may be higher than the expected depth at which the signal is expected to become unreliable as determined via the aforementioned method to ensure adequate signal amplitude is received for reliably telemetry. In some cases, the depth at which downhole receiving system 50 is positioned is between 100 ft and 3500 ft above the depth at which telemetry is expected to become unreliable and in other cases the depth is between 500 ft and 2000 ft above the depth at which telemetry is expected to become unreliable. In other embodiments, the predetermined depth selected for positioning of downhole receiving system 50 may be based on known location of a formation of lower resistivity than adjacent formations. Without being bound by theory, a formation of lower resistivity than adjacent formations may provide a comparatively low resistance path for the signal resulting in a significant reduction in signal strength above the low resistivity formation. Formations such as, for example, salt zones, water saturated zones, and sands or sandstones with clay minerals or pyrite may have low resistivities compared to other formations. Knowledge of the formation type or direct measurement of the resistivity obtained from previous wells drilled in the general geographic location, then, may be used to determine the predetermined depth selected for positioning of downhole receiving system 50. In some embodiments, downhole receiving system 50 may be positioned below or within known low resistivity formations to increase the received telemetry signal strength.

In some embodiments, wireline 51 may be of a monoconductor, which may include a center conductor (often consisting of multiple strands and described hereinafter as an "insulated conductor"), an insulating layer and an outer conductive sheath. In other embodiments, wireline 51 may include an additional insulating layer over the outer conductive sheath; this additional insulating layer may reduce undesirable noise currents generated by drilling equipment from conducting onto the sheath and coupling into the insulated conductor of wireline 51. In yet other embodiments, wireline 51 may be of a multi-conductor including multiple insulated conductors surrounded by a conductive sheath which may be surrounded by an additional insulating layer. Wireline unit 52 may include a depth measurement system such as, for example a draw works encoder, for measuring the depth of downhole receiving system 50 within wellbore 13*a*. Downhole receiving system 50 may include cable head 53, which may connect mechanically to the sheath of wireline 51, thus providing a weight bearing connection to downhole receiving system 50. Cable head 53 may further provide an insulated electrical connection to the insulated conductor of wireline 51.

In an embodiment, downhole receiving system 50 may be configured to operate as a single down-hole electrode, conducting the telemetry signal from EM telemetry system 30 to uplink receiver 36 at the surface. In such an embodiment, downhole receiving system 50 may include shorting adapter 54 connected, such as by threaded connection, to cable head 53 and electrically connecting the insulated conductor of wireline 51 to the body of shorting adapter 54, thereby providing a low resistance electrical connection between the insulated conductor of wireline 51 and downhole receiving system 50. In other embodiments, electrical connection of the insulated conductor of wireline 51 may be made in cable head 53, omitting shorting adapter 54. Wireline units may be configured with cable head 53 providing an insulated connection to the insulated conductor of wireline 51; however, use of shorting adapter 54 may save time associated with re-heading the wireline as would be required to short the insulated conductor of wireline 51 to cable head 53. Downhole receiving system 50 may further include centralizers 55 and 56 and weight bar 57 all fabricated from a conductive material such as, for example steel or brass. Centralizers 55 and 56 and weight bar 57 may be threadedly connected end to end, forming a single, larger conducting electrode. In certain embodiments, a single centralizer may be used, such as centralizer 55 or centralizer 56. In other embodiments, centralizers 55 and 56 may be omitted. In yet other embodiments, weight bar 57 may be omitted. In yet other embodiments, shorting adapter 54 may be omitted.

Centralizers 55 and 56 may centralize the assembly within the cased wellbore and provide electrically conductive contact from casing string 28 of wellbore 13*a* at contact points 58 to downhole receiving system 50. Centralizers 55 and 56 are diagrammatically represented as being of the leaf spring type configured to position downhole receiving system 50 in the middle of the wellbore 13*a* but may be configured to position downhole receiving system 50 against the wall of casing string 28 in a "decentralized" configuration. Weight bar 57 adds weight to downhole receiving system 50 for conveyance of the assembly to the desired downhole location within wellbore 13*a*.

When configured as a downhole electrode, downhole receiving system 50 may conduct the telemetry signal from EM telemetry system 30 at contact points 58 through the insulated conductor of wireline 51 to uplink receiver 36. Uplink receiver 36 may measure the potential difference between contact points 58 and a surface electrode. In some embodiments, ground electrode 60 operates as a surface electrode. Ground electrode 60 may be connected to uplink receiver 36 by an insulated wire which may, in some embodiments, be shielded. In a non-limiting embodiment, ground electrode 60 may be a rod of conductive material such as, for example, copper or iron. In some embodiments, ground electrode 60 is positioned at a distance from rig equipment 23, generator 29 and power cables connecting generator 29 to rig equipment 23 which may reduce received noise. The distance between ground electrode 60 and rig equipment 23, generator 29 and the connecting power cables may be between approximately 50 ft and 5000 ft or between approximately 200 ft and 1000 ft. In another embodiment, the sheath of wireline 51 operates as a surface electrode. In such an embodiment, uplink receiver 36 is configured to measure the potential difference between the insulated conductor and conducting sheath of wireline 51. In some embodiments, the insulated conductor and sheath of wireline 51 are connected to separate insulated conductors of a twisted pair cable for conducting the signal from wireline 51 to uplink receiver 36. In these embodiments, improved rejection of noise coupling into the signal through said cable may be achieved. The sheath of wireline 51 may be left electrically ungrounded or it may be connected via a wire to a ground stake near wireline unit 52 or, preferably, located some distance away from rig equipment 23 to reduce coupling of noise from the equipment into the sheath and from the sheath to the insulated conductor. The distance between the ground stake attached to the sheath of wireline 51 and rig equipment 23 may be between 50 ft and 5000 ft or between 200 ft and 1000 ft. In other embodiments, the top of the casing or wellhead of wellbore 13*a* operates as a surface electrode and uplink receiver 36 is configured to measure the potential difference between the insulated conductor of wireline 51 and the top of the casing or wellhead of wellbore 13*a*. In other embodiments, part of rig equipment 23 operates as a surface electrode and uplink receiver 36 is configured to measure the potential difference between the insulated conductor of wireline 51 and part of rig equipment 23 such as, for example, the blow out preventer (BOP). In yet other embodiments, the casing or wellhead of another nearby wellbore (not shown) operates as a surface electrode and uplink receiver 36 may be configured to measure the potential difference between the insulated conductor of wireline 51 and the casing or wellhead of another nearby wellbore (not shown).

In some embodiments, uplink receiver 36 may be configured to switch between any combination of two of the insulated conductor of wireline, ground electrode 60, ground electrode 61, which may be located closer to drilling rig 12 than ground electrode 60, an electrode attached to a portion rig equipment 23 such as, for example, the BOP, or the wellhead or casing of another nearby wellbore (not shown). In such an embodiment, the switching mechanism of uplink receiver 36 may be an electronic switch, a mechanical switch, or a patch panel or plug by which an operator uses to manually switch between wires.

In another embodiment, the sheath of wireline 51 may be used in combination with one of ground electrode 60, ground electrode 61, ground electrode 63, ground electrode 64 or an electrode attached to a portion of rig equipment 23 such as, for example the BOP, or an electrode attached to the wellhead or casing of another nearby wellbore (not shown) as a noise sensor. In yet other embodiments, any two of the aforementioned electrodes may be used as a noise sensor. Uplink receiver 36 may be configured to simultaneously measure noise from two or more noise sensors as described above so that the measured noise from each noise sensor may be cancelled from the telemetry signal received via the aforementioned methods. Non-limiting methods for cancelling the noise may include use of an adaptive filter operating as a noise cancellation filter as described in "Noise cancellation using adaptive algorithms", *International Journal of Modern Engineering Research* (*IJMER*), Vol. 2, Issue 3, May-June 2012, pp-792-795, Chhikara, et al., which is incorporated herein by reference, or use of an optimal or Weiner filter. In some non-limiting embodiments, multiple adaptive or optimal filters may be cascaded or run in parallel to perform noise cancellation of more than one measured noise signal.

In another embodiment, uplink receiver 36 is configured to simultaneously receive two or more telemetry signals obtained via any of the aforementioned methods and may combine the telemetry signals via diversity combining methods such as, for example, selection diversity, maximal ratio combining, or other optimal combining methods as indicated in "Performance Analysis of Conventional Diversity Combining Schemes in Rayleigh Fading Channel", "Eigen Theory for Optimal Signal Combining: A Unified Approach", "Optimum Combining in Digital Mobile Radio with Cochannel Interference", "The Optimal Weights of A Maximum Ratio Combiner Using An Eigenfilter Approach," all of which are incorporated herein by reference.

In some embodiments, uplink receiver 36 includes one or more fixed value resistors, variable resistors, or potentiometers which may be switched across any pair of inputs previously indicated so as to modify the input resistance of uplink receiver 36 which may in some cases improve received signal to noise ratio. In some embodiments, switching or varying these resistances may be electronically controlled by uplink receiver 36 to improve the received signal to noise ratio. Uplink receiver 36 may also include one or more of a passive analog low pass or band pass filter, a differential or instrumentation amplifier powered off of an isolated power supply the ground of which may be tied to one of the inputs, an isolation amplifier, an automatic gain control circuit or programmable gain amplifier, a 50 or 60 Hz notch filter, and an active band-pass filter for each telemetry signal and noise sensor input. Uplink receiver 36 may also include one or more analog to digital converters and one or more micro-processors and associated memory, for sampling the ADCs, switching or varying the input resistances, controlling the programmable gain amplifiers and performing digital filtering, noise cancellation, and optimal combining of signals as have been described.

In some embodiments bi-directional communication may be achieved by including a transmitter at the surface which may use any of the aforementioned down-hole electrode or surface electrode configurations for transmitting down to a receiver incorporated into downhole receiving system 50 or EM telemetry system 30.

In some embodiments, drill string 21 may include extended dipole antenna 100 for uplink transmitter 32. In such an embodiment, as shown in FIG. 1, extended dipole antenna 100 may include upper dipole terminating sub 104, one or more sections of wired or lined drill pipe segments 106, and electromagnetic telemetry interface sub 108. Upper dipole terminating sub 104, wired or lined drill pipe segments 106, and electromagnetic telemetry interface sub 108 may be coupled to BHA 34 and may each include a common internal conductor 109 extending from electromagnetic telemetry interface sub 108 through wired or lined drill pipe segments 106 to upper dipole terminating sub 104. In some embodiments, drill string 21 may include one or more non-wired tubulars 16 or non-wired drill string components 102 that extend from upper dipole terminating sub 104 to the surface. In some embodiments, non-wired tubulars 16 may be standard conductive drill pipe, drill collar, or other tubulars. In some embodiments, non-wired drill string components 102 may be any non-wired drill string components including, for example and without limitation, jars, friction reducing devices, shock subs, or mud motors.

In some embodiments, as further discussed below, wired or lined drill pipe segments 106 may provide separation between electromagnetic telemetry interface sub 108 and upper dipole terminating sub 104 such that extended dipole antenna 100 created along drill string 21 may be located at a position within wellbore 13*b* spaced apart from BHA 34. For example and without being bound to theory, by increasing the separation between BHA 34 and the dipole antenna, i.e. by increasing the length of the lower electrode of extended dipole antenna 100, contact impedance of the lower electrode to the formation may be decreased, which may result in an increase in current flow through the formation and up to the surface, thus increasing the received signal strength and likelihood that signals are received and decoded when compared to an example in which a gap sub is only included at BHA 34.

Figure 2:
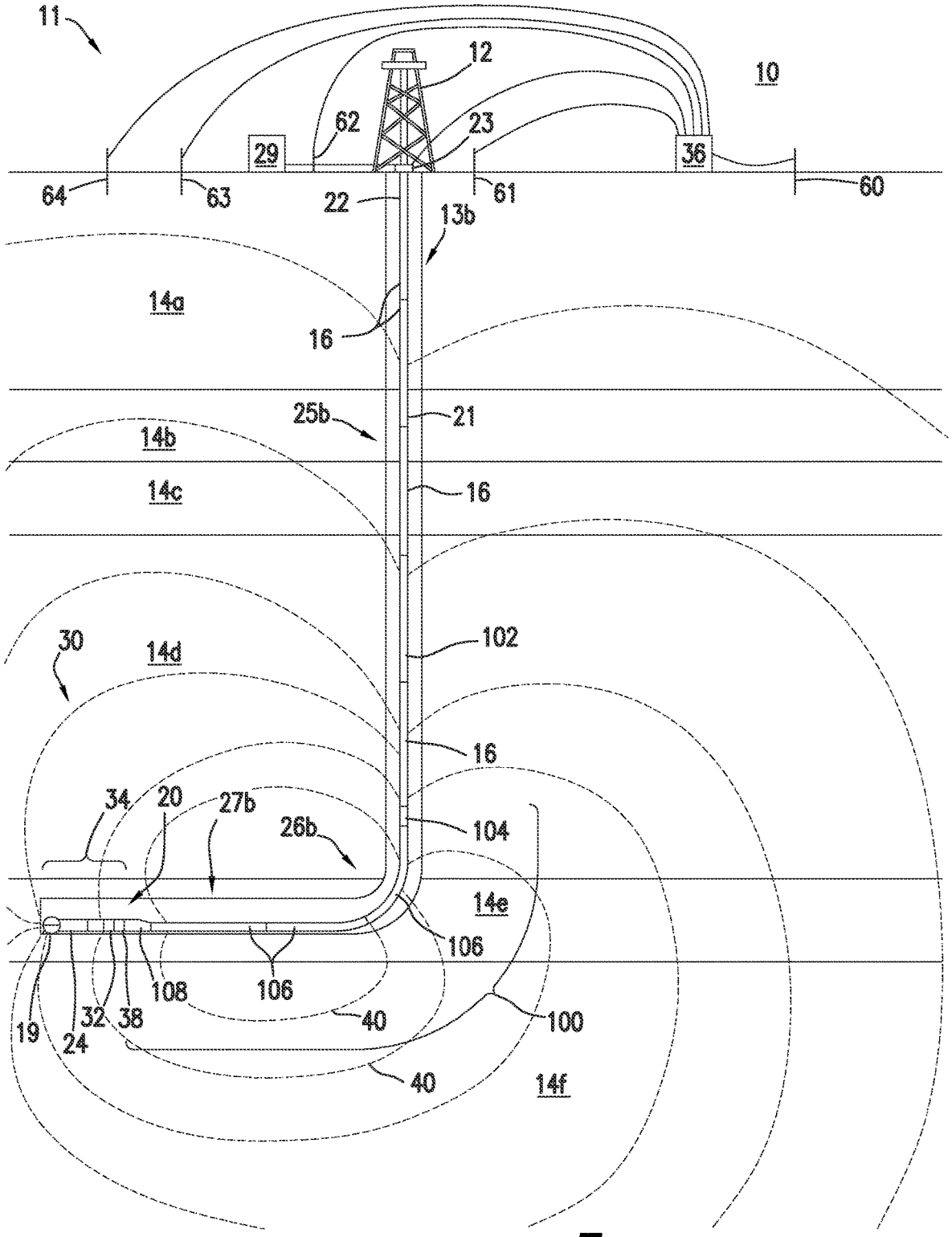
FIG. 2 is a schematic view of a drilling system consistent with at least one embodiment of the present disclosure.
Figure 3:
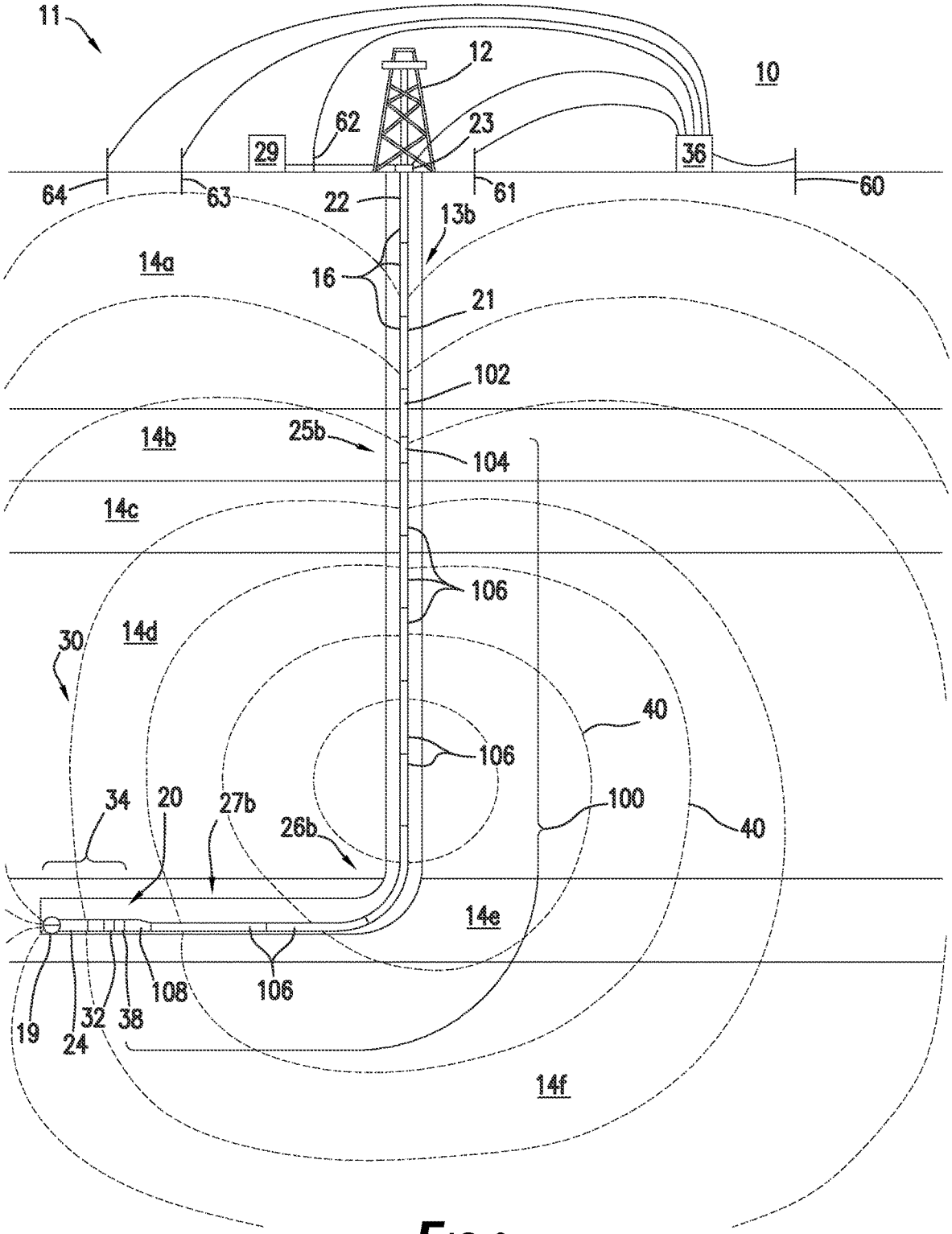
FIG. 3 is a schematic view of a drilling system consistent with at least one embodiment of the present disclosure.

FIGS. 1-3 depict various configurations of extended dipole antennas 100 of various embodiments having exemplary numbers of wired or lined drill pipe segments 106. The number of such wired or lined drill pipe segments 106 are intended to be examples and are not intended to limit the scope of the present disclosure. In some embodiments, such as depicted in FIG. 1, the length of wired or lined drill pipe segments 106 may be selected such that upper dipole terminating sub 104 remains within horizontal section 27*b*. In such an embodiment, the length of wired or lined drill pipe segments 106 may be between 30 and 1,000 feet or between 100 and 500 feet depending on the geometry of wellbore 13*b*.

In other embodiments, such as depicted in FIG. 2, the length of wired or lined drill pipe segments 106 of extended dipole antenna 100 may be selected such that wired or lined drill pipe segments 106 extend through a large portion or the entire length of horizontal section 27*b*. In such an embodiment, the length of wired or lined drill pipe segments may be, for example and without limitation, between 1,000 and 10,000 feet or between 3,000 and 10,000 feet. In such an embodiment, the lower electrode of extended dipole antenna 100 may extend outside of horizontal section 27*b* and may extend out of formation 14*e* within which horizontal section 27*b* is positioned. Such positioning may, for example and without limitation, allow for better reception where formation 14*e* is, for example, relatively low or high resistivity or where formation 14*e* has highly contrasted resistivity, each of which may reduce the ability of a transmission from entirely within formation 14*e* to reach the surface. Additionally, when used in a vertical or curved section, the lower electrode may span across multiple formations, again allowing better transmission than if the lower electrode were positioned only within a difficult formation.

In other embodiments, such as depicted in FIG. 3, wired or lined drill pipe segments 106 may extend from BHA 34 to a position near the surface. In some embodiments, such a position may be, for example and without limitation, between 0 and 10,000 feet or between 1,000 and 3,000 feet. In such an embodiment, the dipole antenna is positioned near to the surface without requiring a fully wired or lined pipe that extends all the way up to the surface. Where a fully wired or lined drill string is used, a rotating connection at the surface, typically through a top drive, is required to receive the transmissions from the BHA. In these embodiments, such complicated connections are not needed, which may improve the reliability of the system. In some embodiments of the present disclosure, a shorting adapter may be used to couple between the uppermost wired or lined drill pipe segment 106 and rig equipment 23 such as a top drive when the uppermost wired or lined drill pipe segment 106 is in connection with the top drive. Such a shorting adapter may, for example and without limitation, short between the insulated conductor of the uppermost wired or lined drill pipe segment 106 and the body of the top drive.

Figure 18:
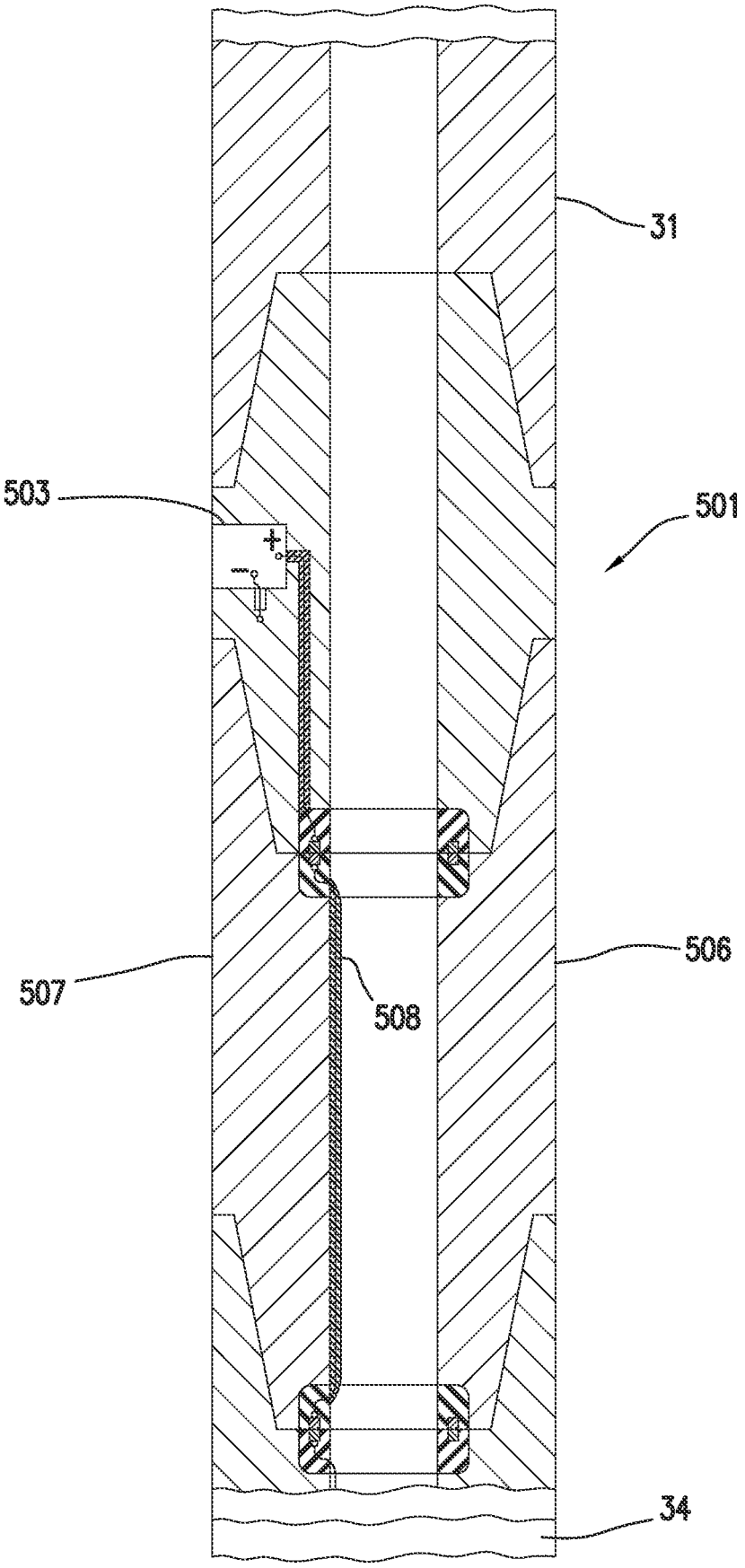
FIG. 18 is a cross section view of a wireless transceiver sub consistent with at least one embodiment of the present disclosure.

In some embodiments, such as depicted in FIG. 18, wired or lined drill pipe segments 506 (depicted as wired drill pipe segments) may extend from BHA 34 up the full length of the wellbore to the surface. In such an embodiment, wireless transceiver sub 501, may connect the topmost wired or lined drill pipe segment 506 to the top drive 31. Wireless transceiver 503 may include, in some embodiments, electronics to measure the voltage across the insulated conductor 508 of wired or lined drill pipe segments 506 and the body 507 of the wired or lined drill pipe segments. In some embodiments, an analog to digital converter may be used to digitize the voltage measurements which may then be wirelessly transmitted using, for example and without limitation, IEEE 802.11, Zigbee, IEEE 802.15.4 or other suitable wireless transmission system across the rig site to a computer or central data collection unit. Alternatively, a processor system may be included in wireless transceiver 503 that may include a signal decoding algorithm that may decode data from the signal represented by the voltage measurements which may then be sent wirelessly across the rig site location to a computer or central data collection unit. In some embodiments, wireless transceiver 503 may include electronics for downlinking to an MWD system located in BHA 34 and connected to the EM MWD system, thus enabling bi-directional communication between BHA 34 and the surface.

Figure 14:
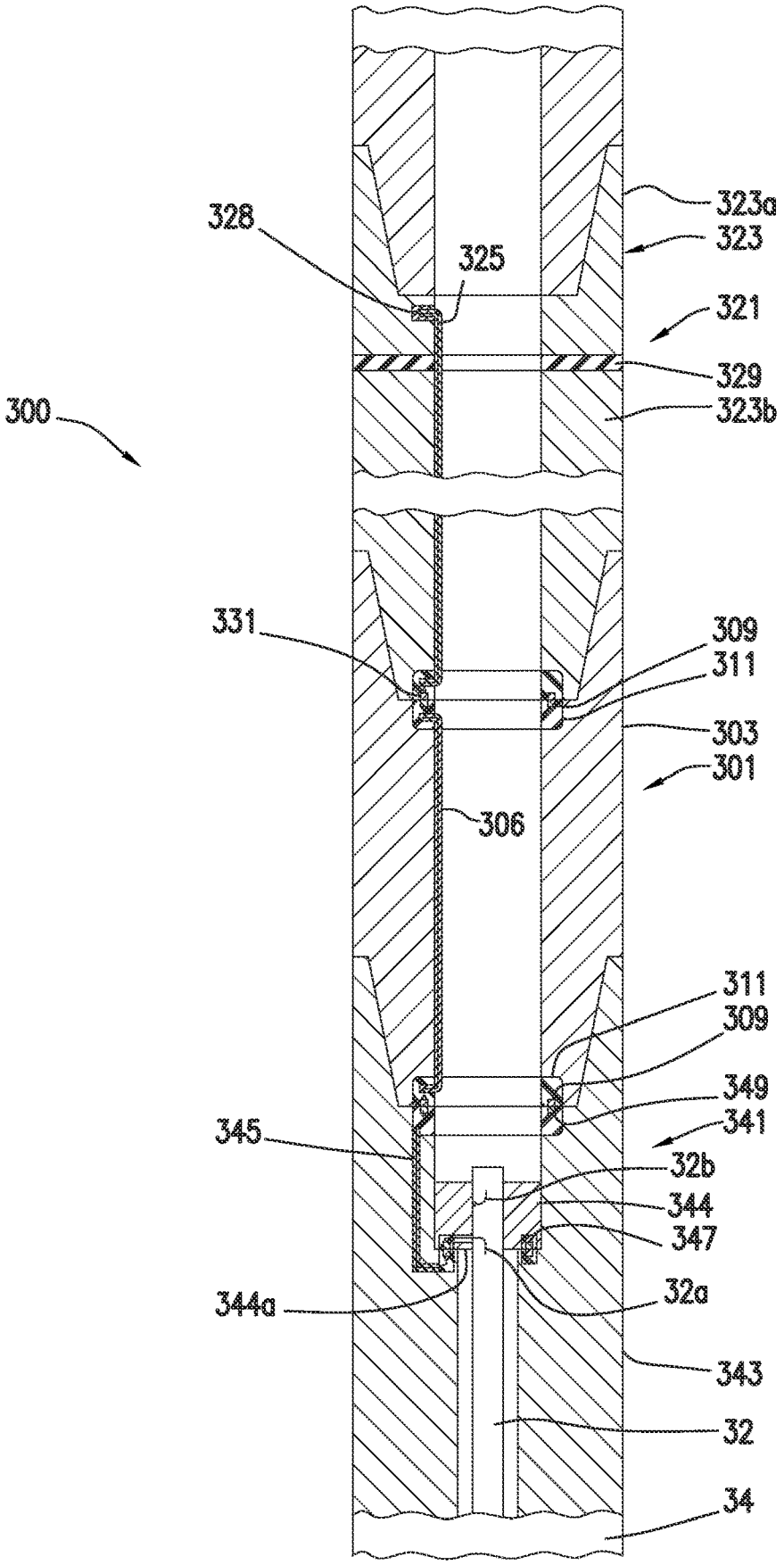
FIG. 14 is a cross section schematic view of an extended dipole antenna consistent with at least one embodiment of the present disclosure.
Figure 15:
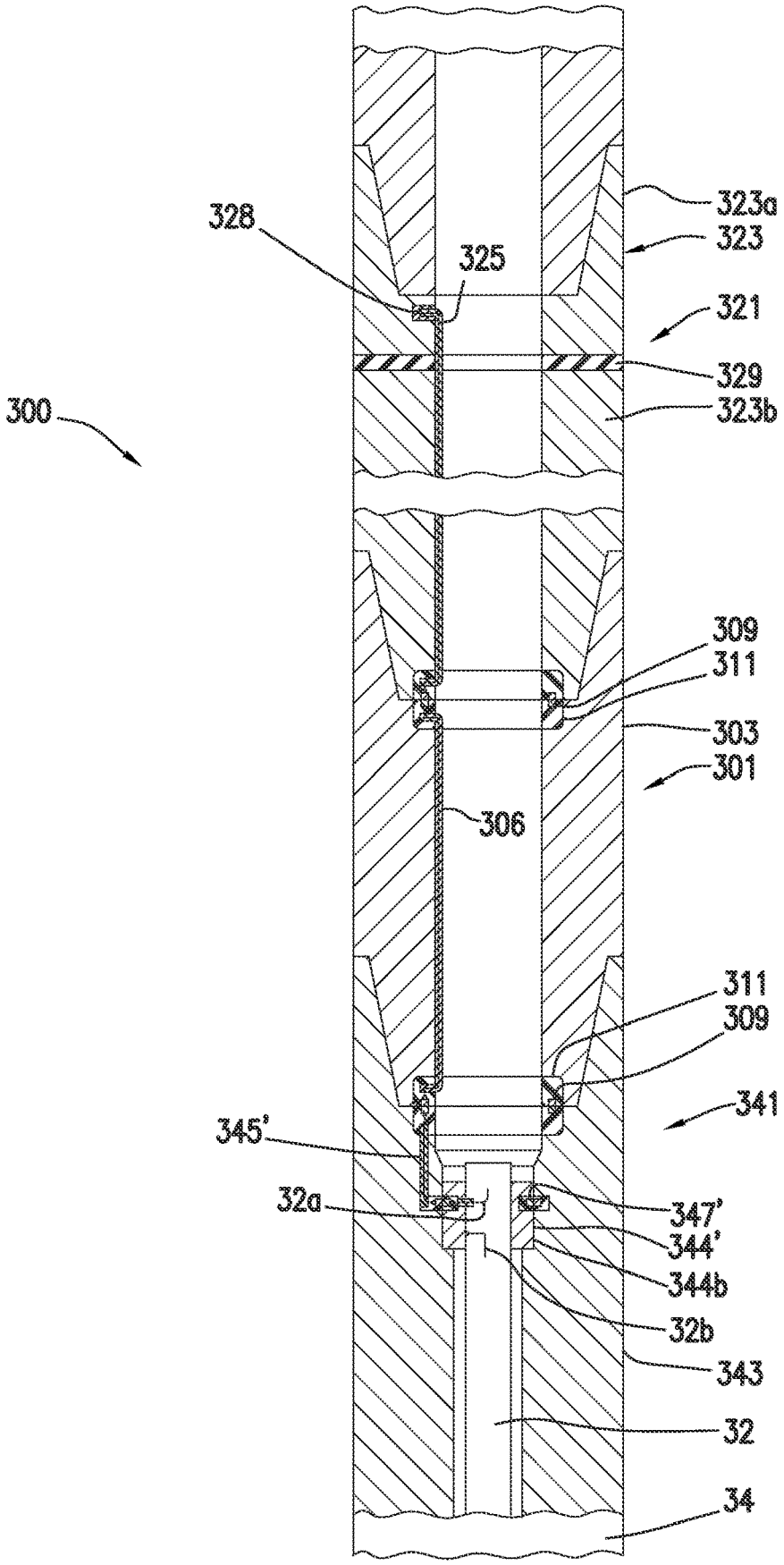
FIG. 15 is a cross section schematic view of an extended dipole antenna consistent with at least one embodiment of the present disclosure.
Figure 16:
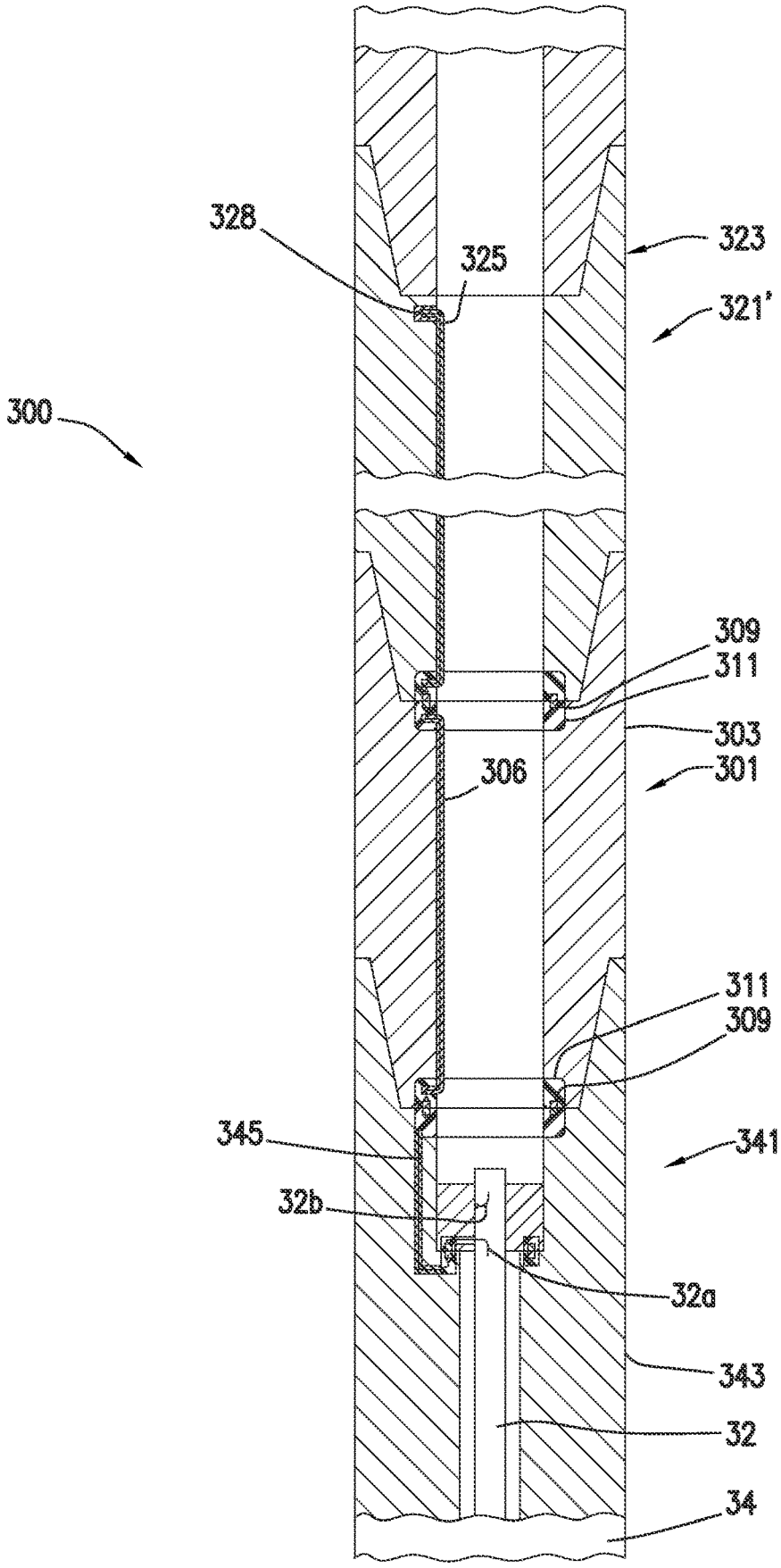
FIG. 16 is a cross section schematic view of an extended dipole antenna consistent with at least one embodiment of the present disclosure.
Figure 17:
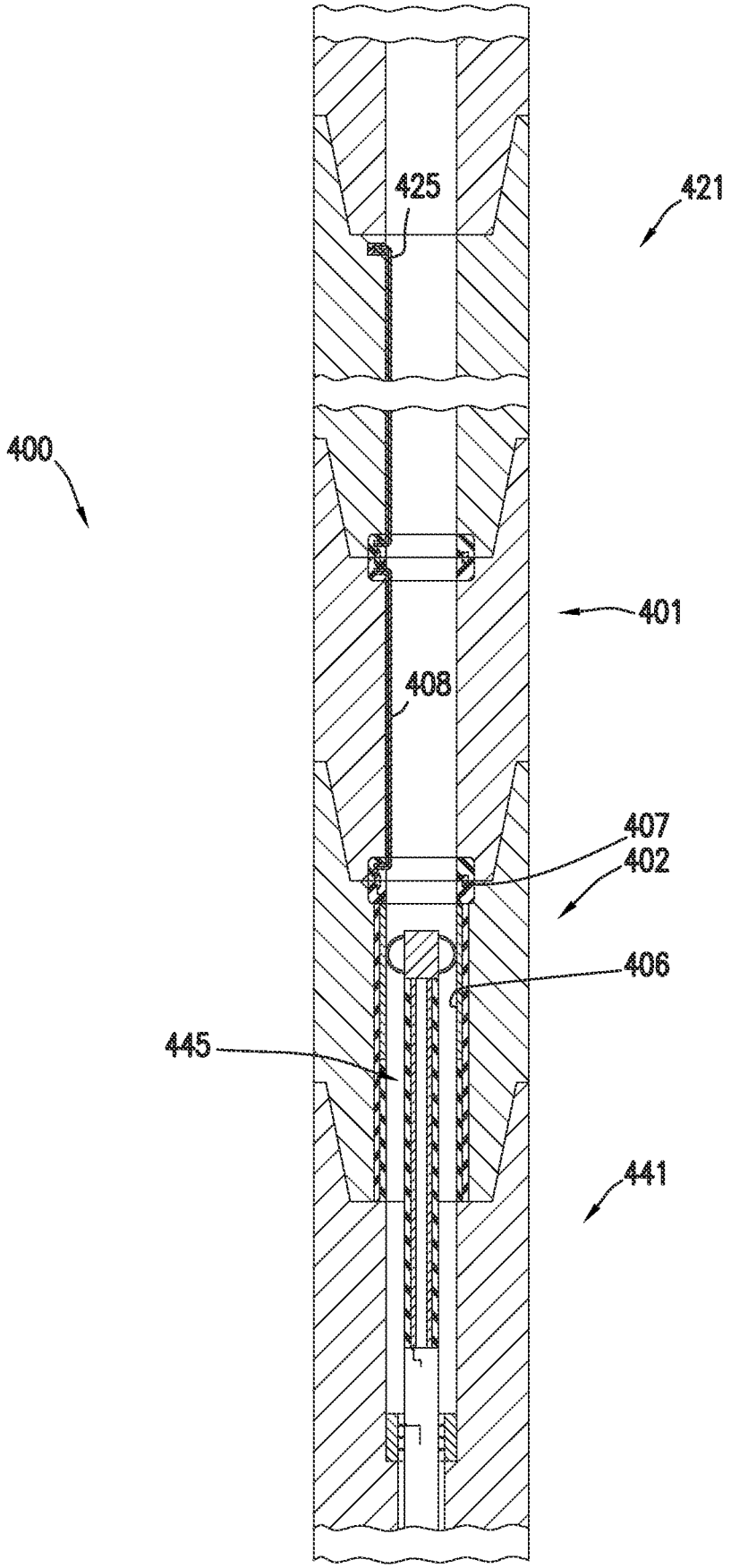
FIG. 17 is a cross section schematic view of an extended dipole antenna consistent with at least one embodiment of the present disclosure.

In some embodiments, each wired or lined drill pipe segment 106 may include an outer tubular and an insulated conductor positioned therein. The insulated conductor may be formed as conductive liner or tube 206 as shown in FIGS. 8-13, insulated wire 306 as shown in FIGS. 14-16, or a combination of conductive liner 206 and insulated wire 306 as shown in FIG. 17, as further discussed below. In some embodiments, one or more wired or lined drill pipe segments 106 may be constructed by modifying standard drill pipe, drill collar, or heavy weight drill collar. Alternatively, in some embodiments, one or more wired or lined drill pipe segments 106 may include wired versions of other drill string components. The outer tubular is typically formed from a conductive metal. The insulated conductor is electrically insulated from the outer tubular. The outer tubulars of adjacent wired or lined drill pipe segments 106 are in electrical contact unless a gap sub is included therebetween.

Each wired or lined drill pipe segment 106 is configured such that the insulated conductor of each wired or lined drill pipe segment 106 is in electrical contact. FIG. 6 depicts a cross section view of lined drill pipe segment 201. Lined drill pipe segment 201 may include outer tubular 203 and conductive liner 206. Conductive liner 206 may be electrically insulated from outer tubular 203 by insulating layer 204. Conductive liner 206 may be configured to be in electrical contact with conductive liners of adjacent lined drill pipe segments 201.

Figure 6A:
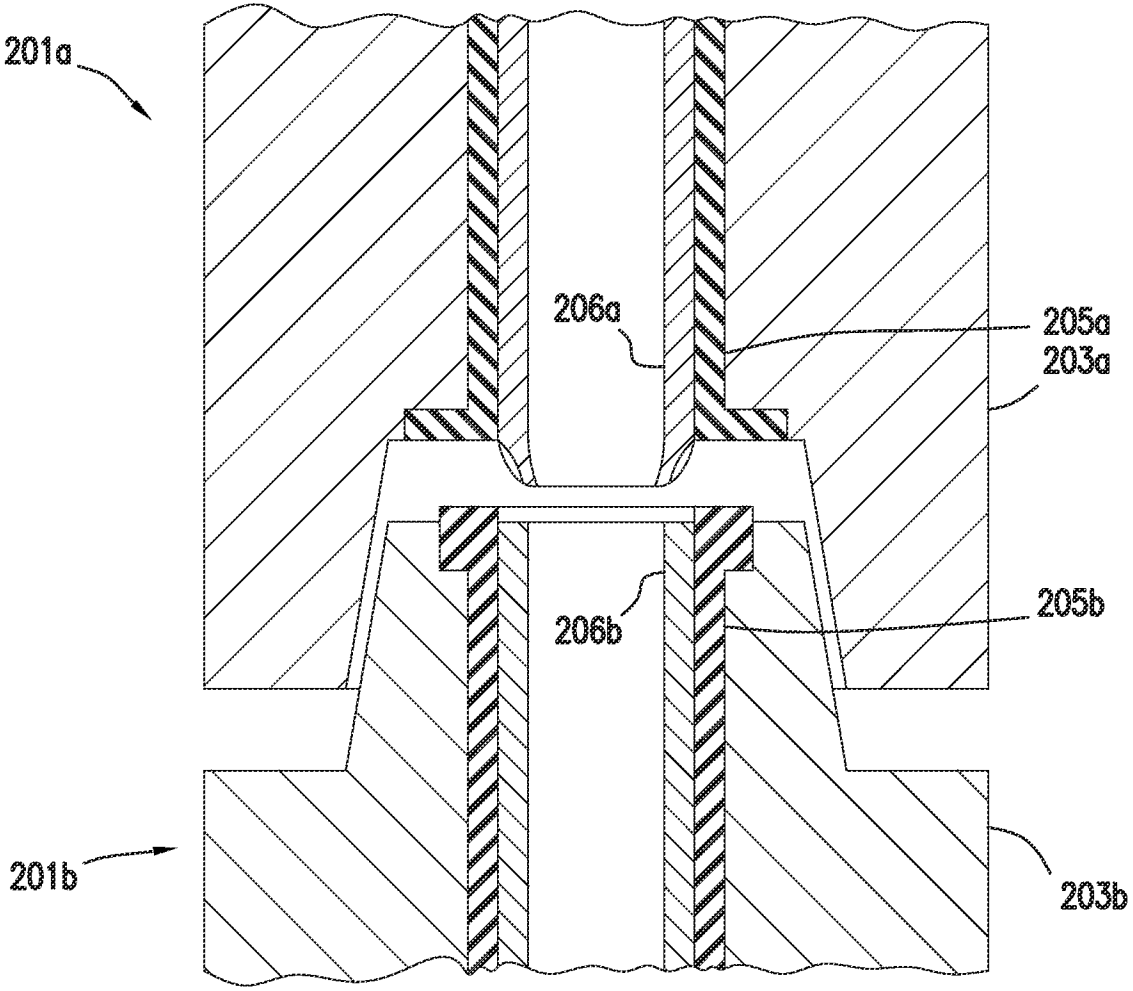
FIG. 6A is a detail cross section view of a connection between two lined drill pipes consistent with at least one embodiment of the present disclosure.
Figure 6:
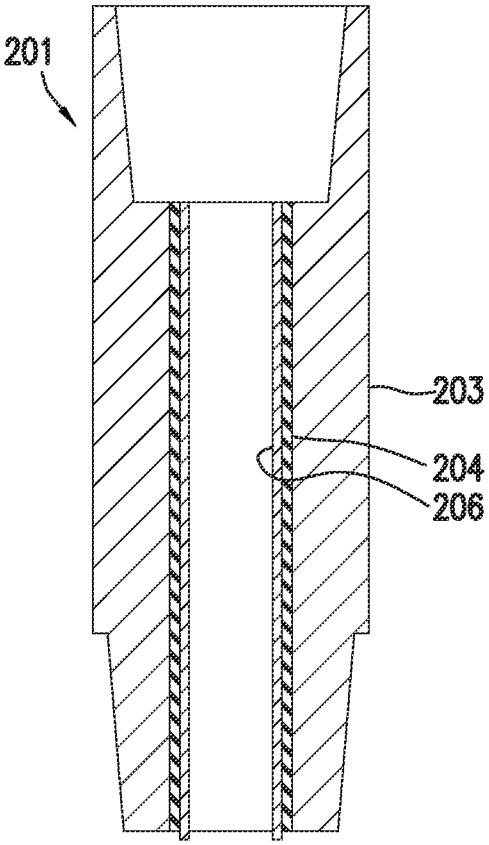
FIG. 6 is a cross section view of a lined drill pipe consistent with at least one embodiment of the present disclosure.
Figure 6B:
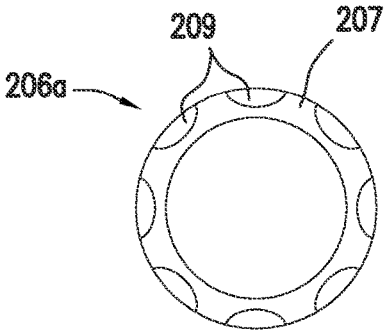
FIG. 6B is an end view of a liner of a lined drill pipe consistent with at least one embodiment of the present disclosure.
Figure 6C:
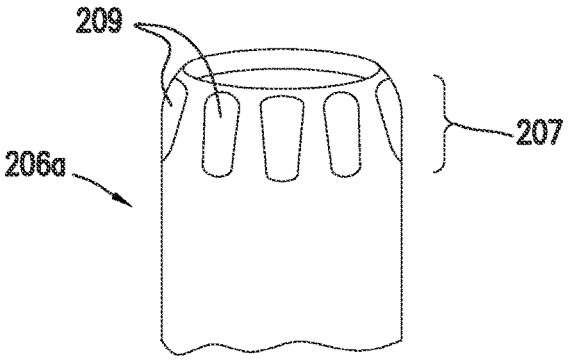
FIG. 6C is a perspective view of the liner of FIG. 6B.

For example, FIG. 6A depicts first lined drill pipe segment 201*a* having first outer tubular 203*a* and first conductive liner 206*a* and second lined drill pipe segment 201*b* having second outer tubular 203*b* and second conductive liner 206*b*. Each conductive liner 206*a*, 206*b* is electrically insulated from the corresponding outer tubular 203*a*, 203*b* by an insulator 205*a*, 205*b*, respectively. In the embodiment shown in FIG. 6A, first conductive liner 206*a* engages with second conductive liner 206*b* when first lined drill pipe segment 201*a* is coupled or threaded to second lined drill pipe segment 201*b*. In some embodiments, first conductive liner 206*a* may be shaped such that first conductive liner 206*a* at least partially fits into second conductive liner 206*b* to, for example and without limitation, reduce or prevent fluid from flowing from within conductive liners 206*a*, 206*b*, past insulators 205*a*, 205*b*, and into contact with outer tubulars 203*a*, 203*b*. Such fluid ingress may result in unwanted conductance between conductive liners 206*a*, 206*b* and outer tubulars 203*a*, 203*b*. In some embodiments, as shown in FIGS. 6B, 6C, first conductive liner 206*a* may include tapered portion 207. In some embodiments, first conductive liner 206*a* may include one or more cutouts 209 formed in the end thereof that fits into second conductive liner 206*b* such that as first conductive liner 206*a* is engaged to second conductive liner 206*b*, first conductive liner 206*a* may be pinched together to conform to the corresponding surface of second conductive liner 206*b*.

Figure 6D:
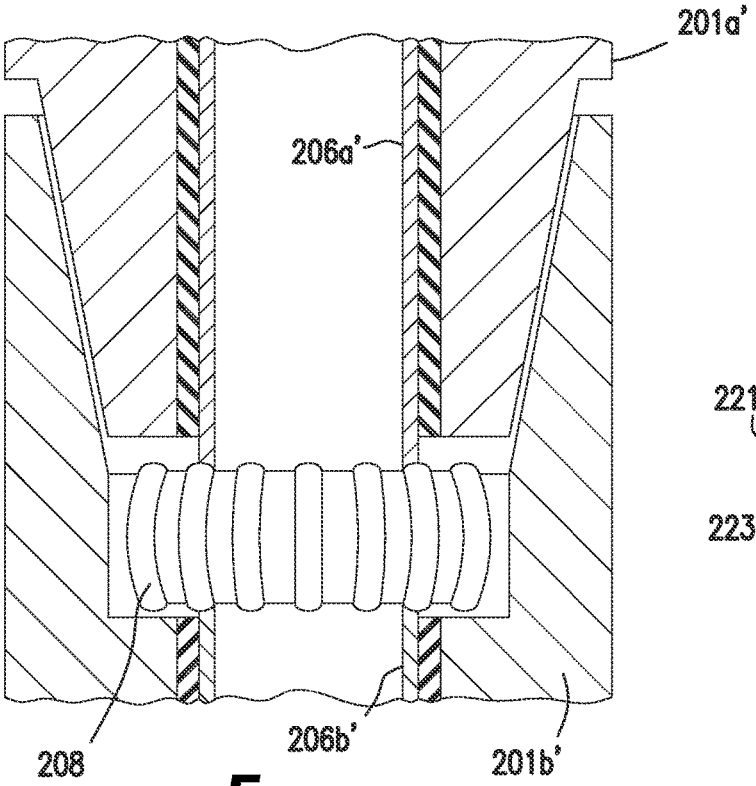
FIG. 6D is a detail cross section view of a connection between two lined drill pipes consistent with at least one embodiment of the present disclosure.

In some embodiments, as shown in FIG. 6D, instead of a direct, physical connection between adjacent conductive liners 206*a*', 206*b*', first lined drill pipe segment 201*a*' or second lined drill pipe segment 201*b*' may include an inductive connection. In such an embodiment, conductive liner 206*a*', conductive liner 206*b*', or each of conductive liner 206*a*' and conductive liner 206*b*' may be electrically coupled to an inductive coil 208, shown in FIG. 6D as coupled to second conductive liner 206*b*'. In such an embodiment, electrical signals on second conductive liner 206*b*' may be induced onto first conductive liner 206*a*' using inductive coil 208, such that no physical contact between first conductive liner 206*a*' and second conductive liner 206*b*' is necessary. The elimination of such physical contact may, for example and without limitation, allow for greater resiliency of the electrical connection between first conductive liner 206*a*' and second conductive liner 206*b*' despite flexure or other movement of drill string 21.

Figure 7:
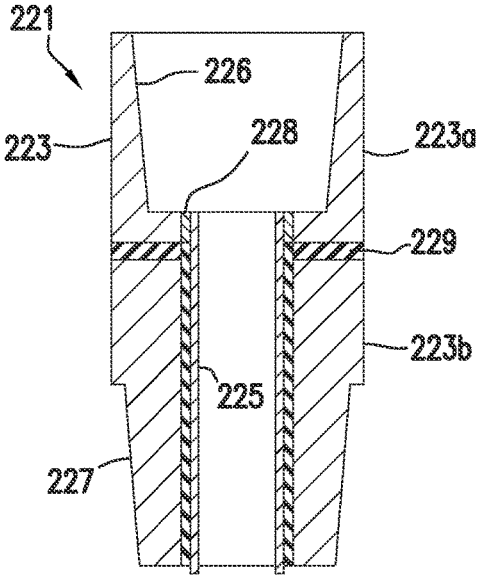
FIG. 7 is a cross section view of an upper dipole terminating sub consistent with at least one embodiment of the present disclosure.

With reference to FIG. 1, upper dipole terminating sub 104 may provide a conductive connection of the insulated conductor of wired or lined drill pipe segments 106 to non-wired tubulars 16 and any non-wired drill string components 102 coupled to upper dipole terminating sub 104. For example and without limitation, FIG. 7 depicts an example of upper dipole terminating sub 221 consistent with at least one embodiment of the present disclosure. Upper dipole terminating sub 221, as shown in FIG. 7, may be used with lined drill pipe segments 201 as discussed above. Upper dipole terminating sub 221 may include outer tubular 223 and conductive liner 225. Outer tubular 223 may couple to an adjacent non-wired tubular 16 at upper connector 226. Outer tubular 223 may couple to an adjacent lined drill pipe segment 201 at lower connector 227 and may be electrically coupled to outer tubular 203 thereof. Conductive liner 225 of upper dipole terminating sub 221 may electrically couple to conductive liner 206 of the adjacent lined drill pipe segment 201. Upper dipole terminating sub 221 may include at least one electrical connection 228 between outer tubular 223 and conductive liner 225 of upper dipole terminating sub 221.

In some embodiments, upper dipole terminating sub 221 may include insulating gap 229. Insulating gap 229 may be formed in outer tubular 223 and may electrically isolate upper sub 223*a* from lower sub 223*b*. In some such embodiments, conductive liner 225 may be electrically coupled to upper sub 223*a* such that, in some embodiments, extended dipole antenna 100 is formed across insulating gap 229.

In some embodiments, with reference to FIG. 1, electromagnetic telemetry interface sub 108 may provide a conductive connection between the positive output of an electromagnetic transmitter, such as uplink transmitter 32, and the insulated conductor of wired or lined drill pipe segments 106 while also providing a separate conductive connection between the negative output of the electromagnetic transmitter and the body of electromagnetic telemetry interface sub 108. In some embodiments, the body of electromagnetic telemetry interface sub 108 may be in electrical connection with the outer tubulars of wired or lined drill pipe segments 106.

Figure 8:
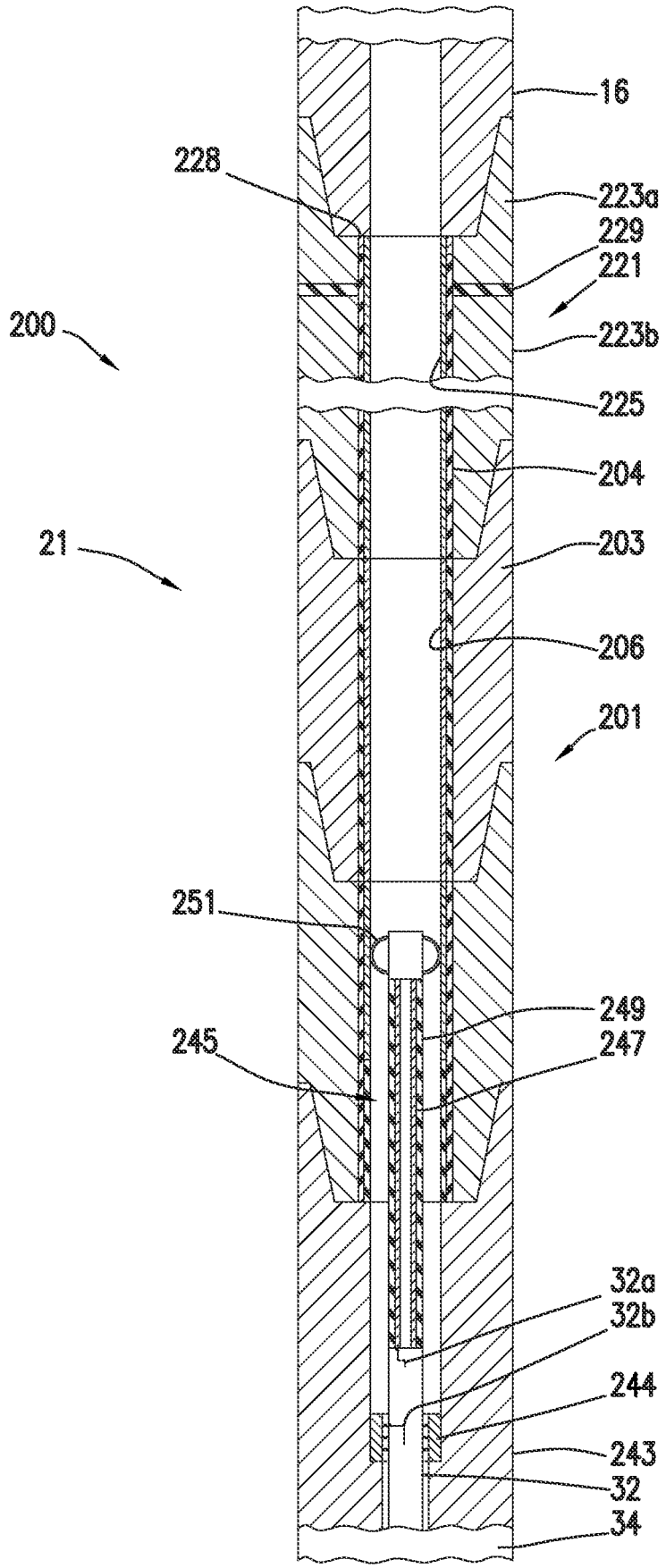
FIG. 8 is a cross section schematic view of an extended dipole antenna consistent with at least one embodiment of the present disclosure.

As an example, FIG. 8 depicts a portion of drill string 21 within wellbore 13*b* making up extended dipole antenna 200. FIG. 8 depicts non wired tubular 16, upper dipole terminating sub 221, lined drill pipe segments 201, and electromagnetic telemetry system interface sub 241. In some such embodiments, electromagnetic telemetry system interface sub 241 may provide for electrical contact between the negative output 32*b* of uplink transmitter 32 and outer tubular 243 of electromagnetic telemetry system interface sub 241. In some embodiments, the electrical contact between the negative output of uplink transmitter 32 and outer tubular 243 of electromagnetic telemetry system interface sub 241 may be provided by a support ring 244.

In some embodiments, electromagnetic telemetry system interface sub 241 may include upper extension 245. In some embodiments, upper extension 245 may include conductive tube 247 and insulating sleeve 249. Conductive tube 247 may be electrically coupled to the positive output 32*a* of uplink transmitter 32. Upper extension 245 may include conductive connector 251. Conductive connector 251 may, in some embodiments, be a centralizer or may include one or more leaf springs positioned to extend between conductive tube 247 and conductive liner 225 such that conductive liner 225 is in electrical connection with the positive output 32*a* of uplink transmitter 32 via conductive liner 206, conductive tube 247, and conductive connector 251. In some embodiments, as discussed above, conductive liner 225 may electrically connect positive output 32*a* with non-wired tubular 16 via upper dipole terminating sub 221.

In embodiments wherein upper dipole terminating sub 221 includes insulating gap 229, such as depicted in FIG. 8, outer tubulars 203 of lined drill pipe segments 201, lower sub 223*b*, and any components of BHA 34 coupled to outer tubular 243 of electromagnetic telemetry system interface sub 241 may thereby form the lower electrode of extended dipole antenna 200 formed on drill string 21, and non-wired tubulars 16 and upper sub 223*a* may form the upper electrode thereof.

Figure 9:
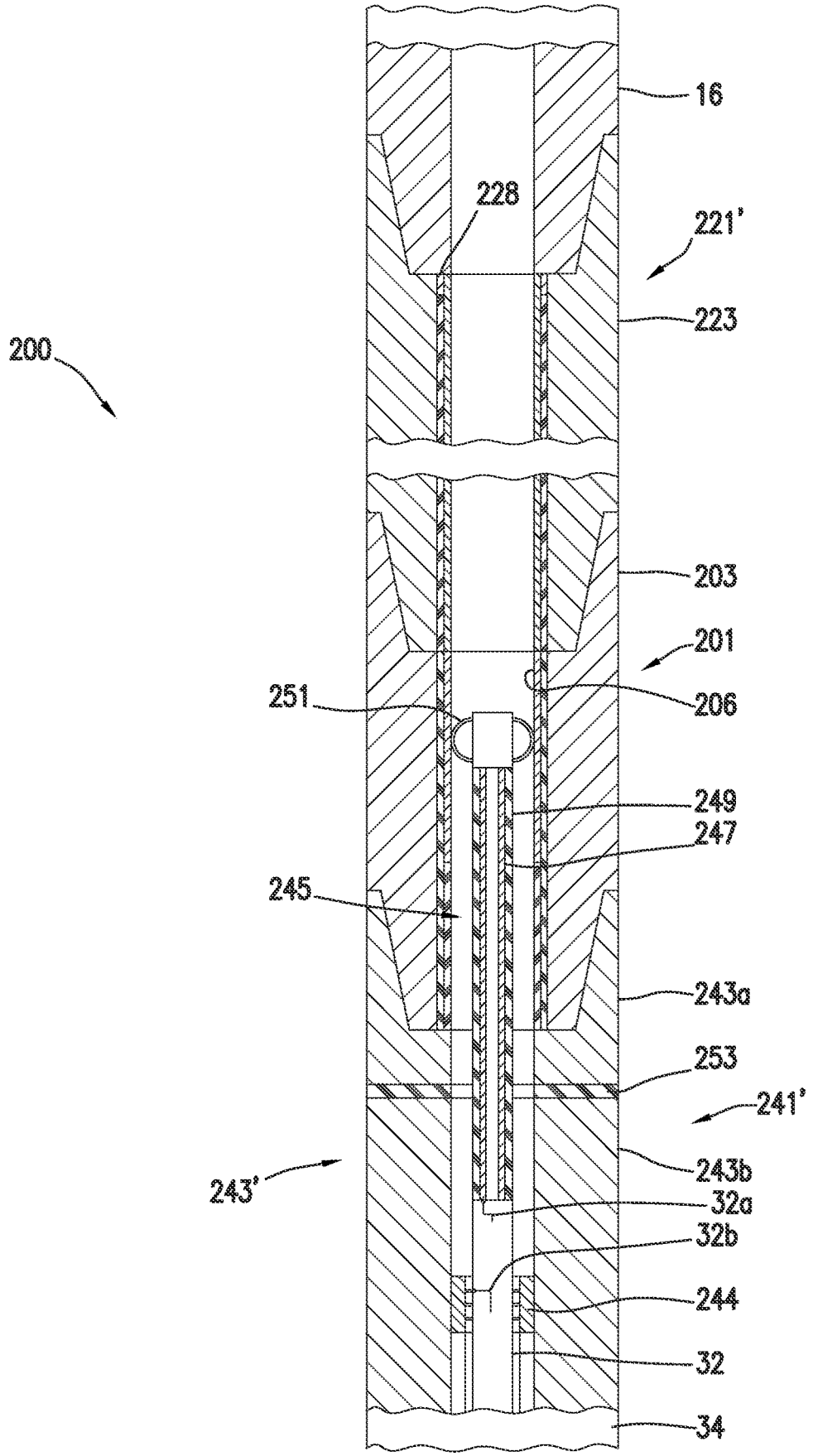
FIG. 9 is a cross section schematic view of an extended dipole antenna consistent with at least one embodiment of the present disclosure.

In some embodiments, as depicted in FIG. 9, upper dipole terminating sub 221' may be formed without insulating gap 229 and electromagnetic telemetry system interface sub 241' may include insulating gap 253. In such an embodiment, outer tubular 243' of electromagnetic telemetry system interface sub 241' may be separated into upper sub 243*a* and lower sub 243*b* such that negative output 32*b* of uplink transmitter 32 is in electrical contact with lower sub 243*b* with insulating gap 253 electrically insulating upper sub 243*a* from negative output 32*b* of uplink transmitter 32. In such an embodiment, lower sub 243*b* and any components of BHA 34 coupled to lower sub 243*b* may form the lower electrode of extended dipole antenna 200 formed on drill string 21, and non-wired tubulars 16, outer tubular 223 of upper dipole terminating sub 221, and outer tubulars 203 of lined drill pipe segments 201 may form the upper electrode thereof.

Figure 10:
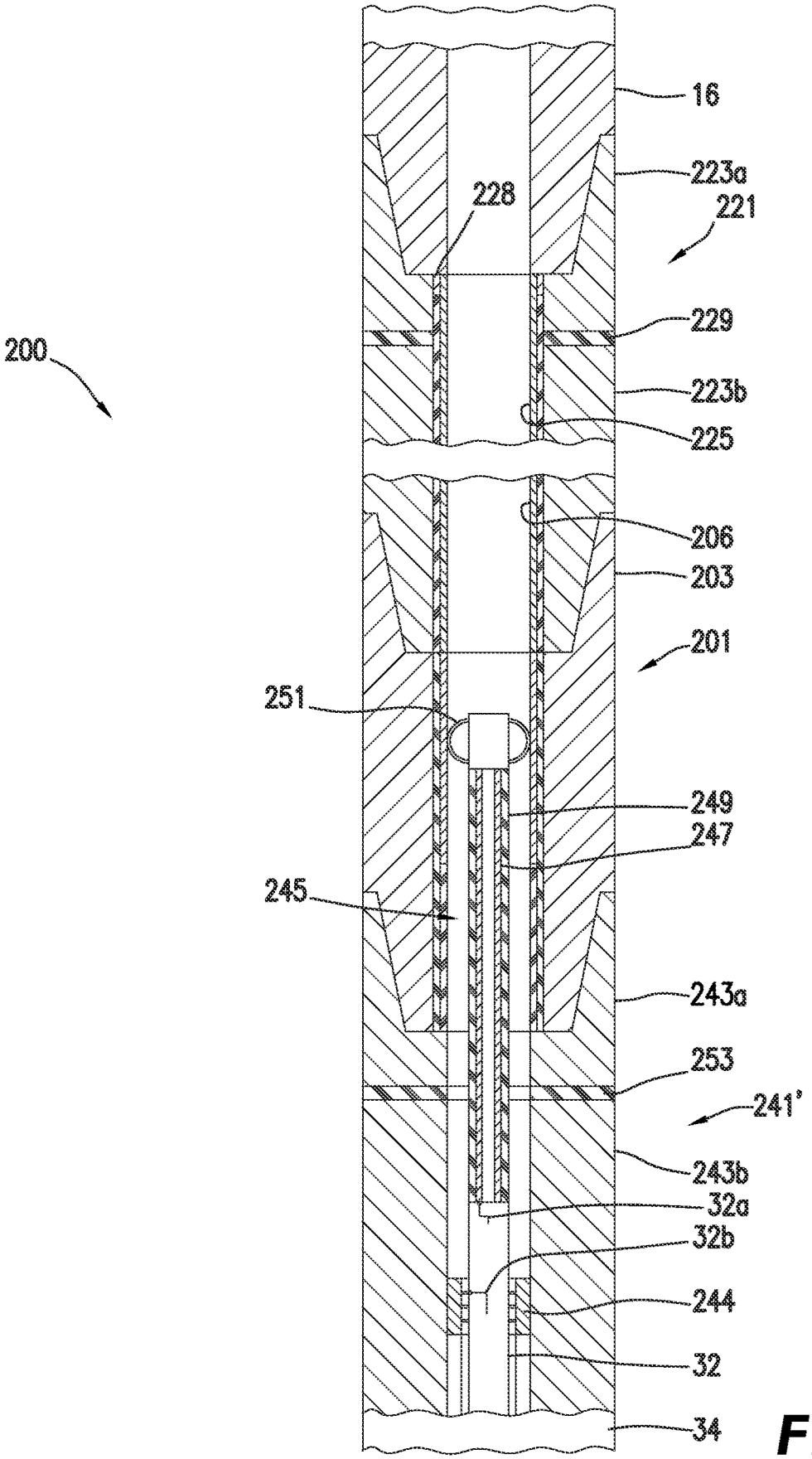
FIG. 10 is a cross section schematic view of an extended dipole antenna consistent with at least one embodiment of the present disclosure.

In other embodiments, as depicted in FIG. 10, drill string 21 may include upper dipole terminating sub 221 that includes insulating gap 229, and electromagnetic telemetry system interface sub 241' that includes insulating gap 253. In some such embodiments, outer tubulars 203 of lined drill pipe segments 201 may be electrically isolated from both positive output 32*a* and negative output 32*b* of uplink transmitter 32. In such an embodiment, lower sub 243*b* and any components of BHA 34 coupled to lower sub 243*b* may form the lower electrode of extended dipole antenna 200 formed on drill string 21, and non-wired tubulars 16 and upper sub 223*a* may form the upper electrode thereof. Without being bound to theory, such a separation may be useful where, for example and without limitation, the resistivity of drilling fluid used is very low, or where the formation resistivity is higher than the resistivity of the drilling fluid, such as where the formation resistivity is two or more orders of magnitude higher than the fluid resistivity. In such cases, the separation may, for example and without limitation, reduce the amount of signal current that shorts through the fluid and increases the amount of signal current reaching the receiver.

Figure 11:
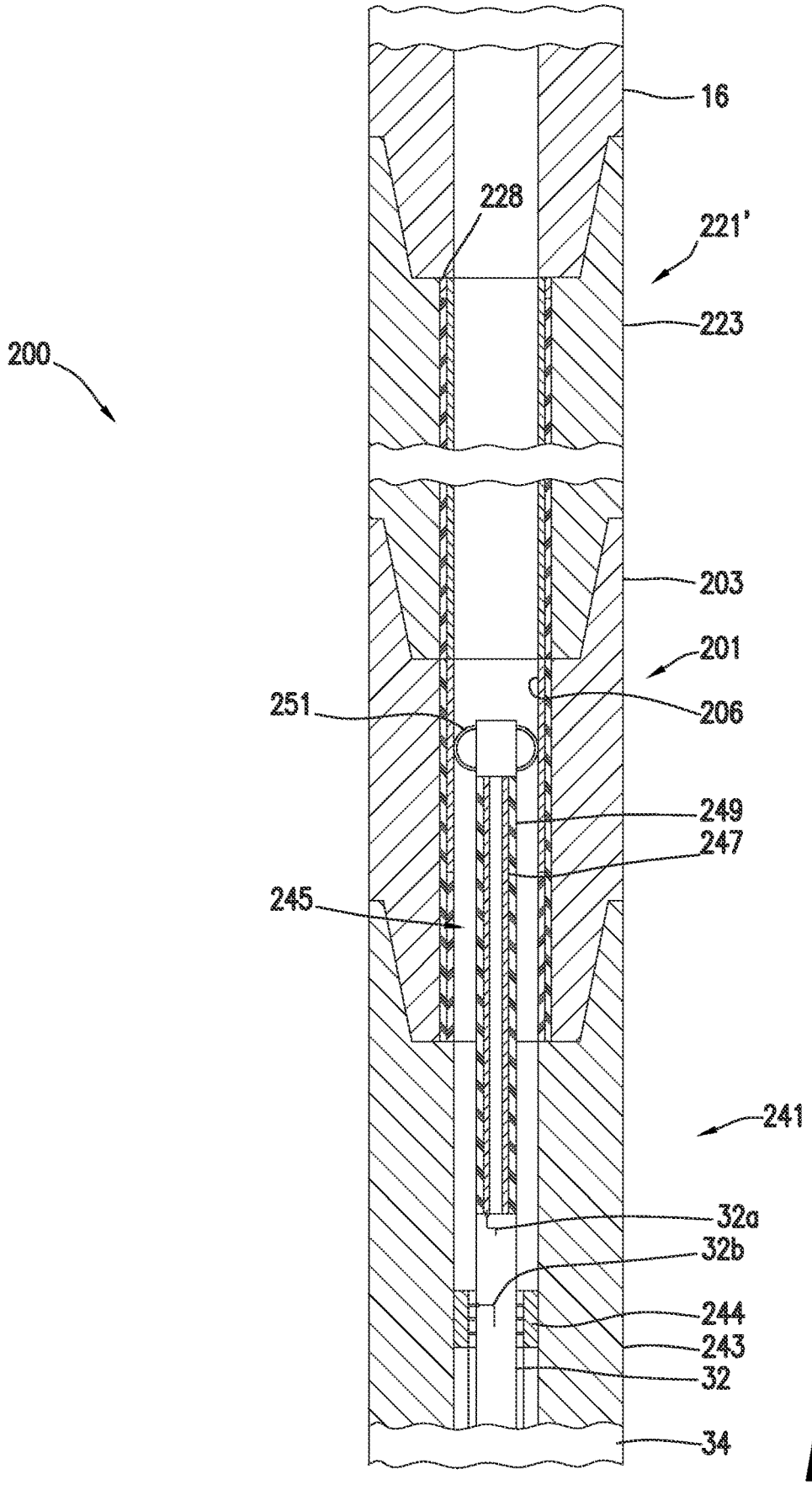
FIG. 11 is a cross section schematic view of an extended dipole antenna consistent with at least one embodiment of the present disclosure.

In some embodiments as shown in FIG. 11, drill string 21 may include upper dipole terminating sub 221' and electromagnetic telemetry system interface sub 241, wherein neither of which includes an insulating gap. In some such embodiments, the length, finite impedance of connections between lined drill pipe segments 201, and pipe may be sufficient to allow the current on outer tubulars 203 of lined drill pipe segments 201 to be low enough that an insulating gap is not necessary to form the dipole antenna. In some such embodiments, the lower electrode of the dipole antenna formed on drill string 21 may be formed from outer tubular 243 of electromagnetic telemetry system interface sub 241 and adjacent outer tubulars 203 of lined drill pipe segments 201 as well as components of BHA 34 coupled to outer tubular 243, and outer tubular 223 of upper dipole terminating sub 221' and outer tubulars 203 of adjacent lined drill pipe segments 201 as well as non-wired tubulars 16 coupled to outer tubular 223 of upper dipole terminating sub 221' may form the upper electrode of extended dipole antenna 200 formed on drill string 21.

Figure 12:
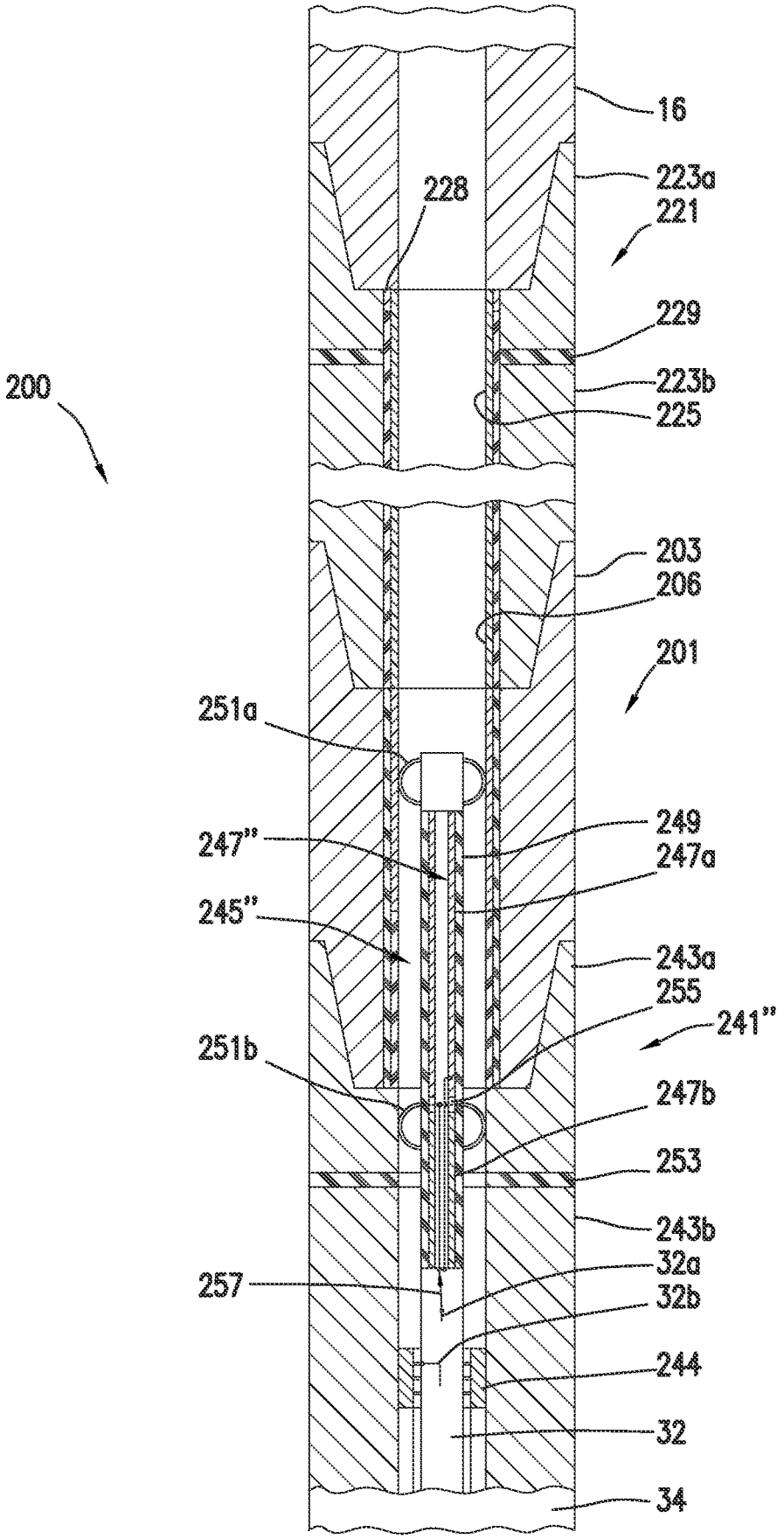
FIG. 12 is a cross section schematic view of an extended dipole antenna consistent with at least one embodiment of the present disclosure.

In some embodiments, electromagnetic telemetry system interface sub 241" as depicted in FIG. 12 may further include insulating gap 255 formed in upper extension 245" positioned to separate conductive tube 247" into upper conductive tube 247*a* and lower conductive tube 247*b*. In some such embodiments, upper conductive tube 247*a* may be electrically coupled to conductive liner 225 by upper conductive connector 251*a*, and lower conductive tube 247*b* may be electrically coupled to upper sub 243*a* of electromagnetic telemetry system interface sub 241". In some such embodiments, electromagnetic telemetry system interface sub 241" may include switch 257 that allows positive output 32*a* of uplink transmitter 32 to be selectively electrically coupled to upper conductive tube 247*a*, lower conductive tube 247*b*, or both upper and lower conductive tubes 247*a* and 247*b*. In such an embodiment, by operating switch 257, upper electrode of extended dipole antenna 200 formed on drill string 21 may be formed by non-wired tubulars 16 and upper sub 223*a* when upper conductive tube 247*a* is electrically coupled to positive output 32*a* of uplink transmitter 32; may be formed by outer tubulars 203 of lined drill pipe segments 201, lower sub 223*b*, and upper sub 243*a* when lower conductive tube 247*b* is electrically coupled to positive output 32*a* of uplink transmitter 32 by, for example and without limitation, lower conductive connector 251*b*; or may be formed by non-wired tubulars 16, upper sub 223*a*, outer tubulars 203 of lined drill pipe segments 201, and upper sub 243*a* when both upper conductive tube 247*a* and lower conductive tube 247*b* are electrically coupled to positive output 32*a* of uplink transmitter 32.

Figure 13:
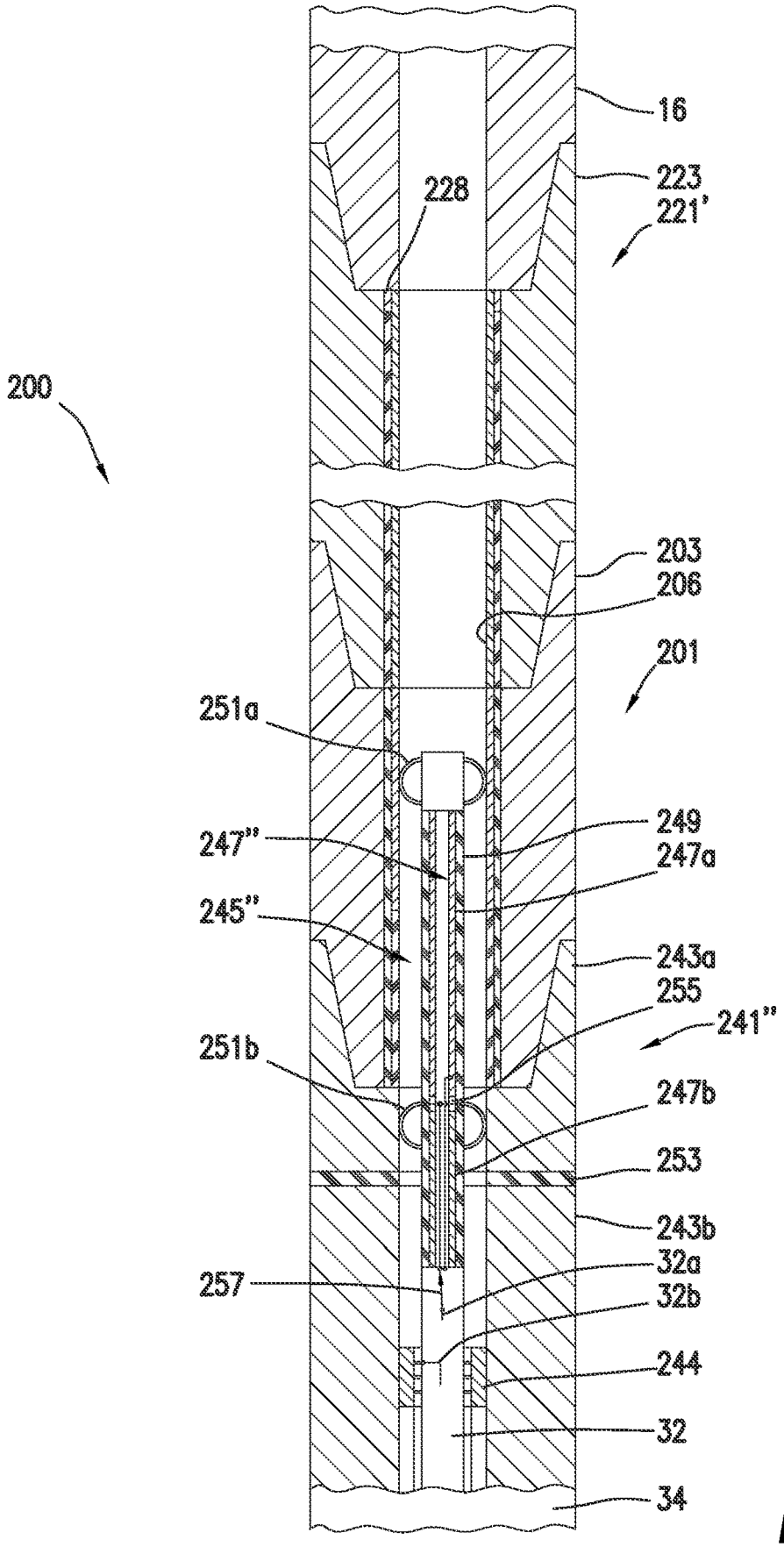
FIG. 13 is a cross section schematic view of an extended dipole antenna consistent with at least one embodiment of the present disclosure.

In some embodiments, as depicted in FIG. 13, drill string 21 may include upper dipole terminating sub 221' that does not include insulating gap 229 and electromagnetic telemetry system interface sub 241" that includes both insulating gap 253 and insulating gap 255 as discussed herein above. In such an embodiment, switching of switch 257 between upper conductive tube 247*a* and lower conductive tube 247*b* may change the location at which positive output 32*a* of uplink transmitter 32 is electrically coupled to the upper electrode of extended dipole antenna 200 formed on drill string 21 between upper dipole terminating sub 221' and upper sub 243*a* of electromagnetic telemetry system interface sub 241".

In some embodiments, rather than using lined pipe, extended dipole antenna 300 of drill string 21 may include wired drill pipe segments 301 as shown in FIGS. 14-16. Example wired drill pipe segments may be commercially obtained elements such as the ReelWell DualLink or NOV IntelliServ. In such embodiments, drill string may include upper dipole terminating subs and electromagnetic telemetry system interface subs configured for use with wired drill pipe segments 301. Each wired drill pipe segment 301 may include outer electrically conductive tubular 303 and insulated wire 306. In some embodiments, each wired drill pipe segment 301 may include conductive connector 309 positioned at each end of wired drill pipe segment 301 to, for example and without limitation, allow for the electrical connection of insulated wire 306 to that of an adjacent component including, for example and without limitation, insulated wire 306 of an adjacent wired drill pipe segment 301, insulated wire 325 of an adjacent upper dipole terminating sub 321, or insulated wire 345 of an adjacent electromagnetic telemetry system interface sub 341. In some embodiments, conductive connector 309 may be formed as, for example and without limitation, a ring connection. In some embodiments, conductive connector 309 may be electrically isolated from outer tubular 303 by insulation 311.

For example, in some embodiments, as depicted in FIG. 14, drill string 21 may include upper dipole terminating sub 321. Similar to upper dipole terminating sub 221, upper dipole terminating sub 321 may include outer tubular 323 and insulated wire 325. Upper dipole terminating sub 321 may include at least one electrical connection 328 between outer tubular 323 and insulated wire 325. In some embodiments, upper dipole terminating sub 321 may include conductive connector 331 positioned to electrically couple insulated wire 325 of upper dipole terminating sub 321 with insulated wire 306 of the adjacent wired drill pipe segment 301 at conductive connector 309.

In some embodiments, outer tubular 323 of upper dipole terminating sub 321 may be separated into upper sub 323*a* and lower sub 323*b* by insulating gap 329. In some such embodiments, insulated wire 325 may be electrically coupled to upper sub 323*a* such that, in some embodiments, extended dipole antenna 300 may be formed across insulating gap 329.

In some embodiments, electromagnetic telemetry system interface sub 341 may provide for electrical contact between negative output 32*b* of uplink transmitter 32 and outer tubular 343 of electromagnetic telemetry system interface sub 341. In some embodiments, the electrical contact between negative output of uplink transmitter 32 and outer tubular 343 of electromagnetic telemetry system interface sub 341 may be provided by support ring 344.

In some embodiments, electromagnetic telemetry system interface sub 341 may include insulated wire 345. Insulated wire 345 may be electrically coupled to positive output 32*a* of uplink transmitter 32. In some embodiments, as depicted in FIG. 14, insulated wire 345 may electrically couple to positive output 32*a* through ring connector 347 positioned on lower face 344*a* of support ring 344. In other embodiments, as depicted in FIG. 15, insulated wire 345' may electrically couple to positive output 32*a* through ring connector 347' positioned on outer cylindrical face 344*b* of support ring 344'.

In some embodiments, electromagnetic telemetry system interface sub 341 may include conductive connector 349 positioned to electrically couple insulated wire 345 of electromagnetic telemetry system interface sub 341 with insulated wire 306 of the adjacent wired drill pipe segment 301 at conductive connector 309 such that upper dipole terminating sub 321 is electrically coupled to positive output 32*a* of uplink transmitter 32 via, for example and without limitation, insulated wires 325, 306, and 345; electrical connection 328; and conductive connectors 331, 309, 349, and 347.

In some embodiments, wherein upper dipole terminating sub 321 includes insulating gap 329, as depicted in FIGS. 14 and 15, outer tubulars 303 of wired drill pipe segments 301, lower sub 323*b*, and any components of BHA 34 coupled to outer tubular 343 of electromagnetic telemetry system interface sub 341 may form the lower electrode of extended dipole antenna 300 formed on drill string 21, and non-wired tubulars 16 and upper sub 323*a* may form the upper electrode thereof.

In some embodiments, as depicted in FIG. 16, drill string 21 may include upper dipole terminating sub 321' and electromagnetic telemetry system interface sub 341, wherein neither of which includes an insulating gap. In some such embodiments, the length, finite impedance of connections between wired drill pipe segments 301, and pipe may be sufficient to allow the voltage on outer tubulars 303 of wired drill pipe segments 301 to be low enough that an insulating gap is not necessary to form the dipole antenna. In some such embodiments, current flow through outer tubulars 303 of wired drill pipe segments 301 may, for example and without limitation, induce current flow in the surrounding formation without a direct conductive contact and may, without being bound to theory, allow reliable and higher data rate telemetry in highly insulating muds and formations when compared to a gapped configuration. In some such embodiments, the lower electrode of extended dipole antenna 300 formed on drill string 21 may be formed from outer tubular 343 of electromagnetic telemetry system interface sub 341 and adjacent outer tubulars 303 of wired drill pipe segments 301 as well as components of BHA 34 coupled to outer tubular 343, and outer tubular 323 of upper dipole terminating sub 321' and outer tubulars 303 of adjacent wired drill pipe segments 301 as well as non-wired tubulars 16 coupled to outer tubular 323 of upper dipole terminating sub 321' may form the upper electrode of the dipole antenna formed on drill string 21.

In some embodiments, drill string 21 may include a combination of lined and wired drill pipe segments. For example, as shown in FIG. 17, extended dipole antenna 400 may include upper dipole terminating sub 421, one or more sections of wired drill pipe segments 401, one or more sections of lined drill pipe segments 402, and electromagnetic telemetry system interface sub 441. In some embodiments, such as those depicted in FIG. 17, electromagnetic telemetry system interface sub 441 may include upper extension 445 as discussed herein above such that upper extension 445 interfaces with conductive liner 406 of a lined drill pipe segment 402 coupled to electromagnetic telemetry system interface sub 441. In some embodiments, upper dipole termination sub 421 may include insulated wire 425 as discussed herein above. In some embodiments, one or more of lined drill pipe segments 402 may include conductive connector 407 positioned to electrically couple between conductive liner 406 and insulating wire 408 of wired drill pipe segment 401 coupled to the lined drill pipe segment 402. One of ordinary skill in the art will understand that various combinations of configurations of upper dipole terminating subs, wired and lined drill pipe segments, and electromagnetic telemetry system interface subs may be used without deviating from the scope of this disclosure.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An extended dipole antenna for an EM telemetry uplink transmitter positioned in a wellbore comprising:

an electromagnetic telemetry system interface sub, the electromagnetic telemetry interface sub including an outer tubular and an inner conductor, at least a portion of the outer tubular of the electromagnetic telemetry interface sub in electrical contact with a negative output of the uplink transmitter, the inner conductor of the electromagnetic telemetry system interface sub in electric contact with a positive output of the uplink transmitter;

a wired or lined drill pipe segment, the wired or lined drill pipe segment including an outer tubular and an inner conductor, the outer tubular in electrical contact with the outer tubular of the electromagnetic telemetry interface sub, the inner conductor in electric contact with the inner conductor of the electromagnetic telemetry system interface sub; and an upper dipole terminating sub, the upper dipole terminating sub including an outer tubular and an inner conductor, the outer tubular at least partially in electric contact with the outer tubular of the wired or lined drill pipe segment, the inner conductor of the upper dipole terminating sub in electric contact with the inner conductor of the wired or lined drill pipe segment, the upper dipole terminating sub including an electrical connection between the inner conductor of the upper dipole terminating sub and the inner conductor of the upper dipole terminating sub.

2. The extended dipole antenna of claim 1, wherein the outer tubular of the electromagnetic telemetry system interface sub further comprises an insulating gap, the insulating gap dividing the outer tubular into an upper sub and a lower sub, the upper sub electrically isolated from the lower sub, wherein the lower sub is in electrical contact with the negative output of the uplink transmitter.

3. The extended dipole antenna of claim 1, wherein the outer tubular of the upper dipole terminating sub further comprises an insulating gap, the insulating gap dividing the outer tubular into an upper sub and a lower sub, the upper sub electrically isolated from the lower sub, wherein the upper sub is in electrical contact with the internal conductor of the upper dipole terminating sub.

4. A system comprising:

a drill string, the drill string including:

an EM telemetry uplink transmitter, the uplink transmitter having a positive output and a negative output; and an extended dipole antenna, the extended dipole antenna including:

an electromagnetic telemetry system interface sub, the electromagnetic telemetry interface sub including an outer tubular and an inner conductor, at least a portion of the outer tubular of the electromagnetic telemetry interface sub in electrical contact with the negative output of the uplink transmitter, the inner conductor of the electromagnetic telemetry system interface sub in electric contact with the positive output of the uplink transmitter;

a wired or lined drill pipe segment, the wired or lined drill pipe segment including an outer tubular and an inner conductor, the outer tubular in electrical contact with the outer tubular of the electromagnetic telemetry interface sub, the inner conductor in electric contact with the inner conductor of the electromagnetic telemetry system interface sub; and an upper dipole terminating sub, the upper dipole terminating sub including an outer tubular and an inner conductor, the outer tubular at least partially in electric contact with the outer tubular of the wired or lined drill pipe segment, the inner conductor of the upper dipole terminating sub in electric contact with the inner conductor of the wired or lined drill pipe segment, the upper dipole terminating sub including an electrical connection between the inner conductor of the upper dipole terminating sub and the inner conductor of the upper dipole terminating sub.

5. The system of claim 4, further comprising an uplink receiver, the uplink receiver positioned at the surface to receive signals transmitted by the uplink transmitter using the extended dipole antenna as measured using one or more surface electrodes.

6. The system of claim 5, wherein the uplink receiver utilizes a downhole receiving system placed in an offset wellbore.

* * * * *